US011047099B2

(12) United States Patent
Hosokawa

(10) Patent No.: US 11,047,099 B2
(45) Date of Patent: Jun. 29, 2021

(54) PASS BLOCKING APPARATUS

(71) Applicant: KOEI INDUSTRY CO., LTD., Kanagawa (JP)

(72) Inventor: Hiroshi Hosokawa, Kanagawa (JP)

(73) Assignee: KOEI INDUSTRY CO., LTD., Kanagawa (JP)

( * ) Notice: Subject to any disclaimer, the term of this patent is extended or adjusted under 35 U.S.C. 154(b) by 59 days.

(21) Appl. No.: 16/569,800

(22) Filed: Sep. 13, 2019

(65) Prior Publication Data

US 2020/0087874 A1 Mar. 19, 2020

(30) Foreign Application Priority Data

Sep. 14, 2018 (JP) ..... JP2018-172159
May 10, 2019 (JP) ..... JP2019-089958

(51) Int. Cl.
*E01F 13/00* (2006.01)
*E01F 13/06* (2006.01)

(52) U.S. Cl.
CPC ..... *E01F 13/06* (2013.01)

(58) Field of Classification Search
CPC ..... E01F 13/06
USPC ..... 49/49
See application file for complete search history.

(56) References Cited

U.S. PATENT DOCUMENTS 3,877,174 A * 4/1975 McDonald ..... B61L 29/22 49/334
3,975,861 A * 8/1976 Baump ..... E01F 13/06 49/28
4,926,111 A * 5/1990 Lungu ..... H01F 5/00 323/355

(Continued)

FOREIGN PATENT DOCUMENTS

JP H11-61752 A 3/1999
JP H11-315517 A 11/1999

(Continued)

OTHER PUBLICATIONS

Office Action issued in Japanese Patent Application No. 2019-089958 dated Apr. 28, 2020 with English translation provided.

*Primary Examiner* — Jerry E Redman
(74) *Attorney, Agent, or Firm* — Nixon & Vanderhye

(57) ABSTRACT

A pass blocking apparatus includes a mechanism for permitting the intentional release of a blocking bar from a closed position to an evacuation position as necessary. The apparatus includes a blocking bar, hinge connection unit, biasing unit, and resistance unit. The blocking bar extends perpendicularly to the driving shaft axis, thereby swinging vertically by driving shaft rotation. The hinge connection unit connects the blocking bar to the driving shaft permits the blocking bar to swing horizontally from the closed to the evacuation position. The biasing unit applies a biasing force to the blocking bar, swinging the blocking bar toward the evacuation position. The resistance unit holds the blocking (Continued)

bar in the closed position against the biasing force. The resistance unit includes an electromagnetic device and a magnetic material, and generates the resistance force from a magnetic force by the electromagnetic device that attracts the magnetic material.

5 Claims, 24 Drawing Sheets

(56) References Cited

U.S. PATENT DOCUMENTS

| | | | | |
|---|---|---|---|---|
| 5,502,367 | A * | 3/1996 | Jones | E01F 13/06 246/128 |
| 5,662,553 | A * | 9/1997 | Reichlinger | B60W 10/02 361/154 |
| 6,460,292 | B1 * | 10/2002 | Rodriguez | E01F 13/06 16/320 |
| 8,695,276 | B2 * | 4/2014 | Zhang | E05F 15/00 49/49 |
| 2006/0228177 | A1 * | 10/2006 | Allain | E01F 13/06 404/6 |
| 2008/0085149 | A1 * | 4/2008 | Gamache | B61L 29/04 403/54 |
| 2010/0115843 | A1 * | 5/2010 | Gallenschuetz | E06B 11/08 49/49 |
| 2012/0011774 | A1 * | 1/2012 | Arnaud | E01F 13/06 49/49 |
| 2014/0305927 | A1 * | 10/2014 | Alexander | A47J 41/0044 219/387 |
| 2015/0033628 | A1 * | 2/2015 | Barwick | E05F 15/616 49/13 |
| 2020/0348343 | A1 * | 11/2020 | Balid | G01R 19/155 |

FOREIGN PATENT DOCUMENTS

| | | | |
|---|---|---|---|
| JP | 2000-043729 | A | 2/2000 |
| JP | 2001-348827 | A | 12/2001 |
| JP | 2011-058333 | A | 3/2011 |
| JP | 2012-102512 | A | 5/2012 |
| JP | 2012-214991 | A | 11/2012 |
| JP | 2015-155643 | A | 8/2015 |
| JP | 2016-056617 | A | 4/2016 |
| KR | 2013-0042106 | A | 4/2013 |

* cited by examiner

Released State

Return Operation

Return Completion

PASS BLOCKING APPARATUS

CROSS-REFERENCE TO RELATED APPLICATION(S)

This application is based upon and claims the benefit of priority of the prior Japanese Patent Applications No. 2018-172159, filed on Sep. 14, 2018, and No. 2019-089958, filed on May 10, 2019, the entire contents of which are incorporated herein by reference.

TECHNICAL FIELD

The invention relates to a pass blocking apparatus for blocking vehicle traffic or the like, in particular, a pass blocking apparatus including a blocking bar which is vertically swung between an open position and a closed position.

BACKGROUND ART

For example, JP2011-058333A discloses a pass blocking apparatus (gate bar apparatus) which is located at an electronic toll collection (ETC) lane of a freeway. This pass blocking apparatus is provided for the following purpose. When a blocking bar, which has been horizontally swung to an evacuation position due to vehicle contact or other reasons, returns in a horizontally-swung manner to a closed position by means of a biasing force (for example, as disclosed in JP2000-043729A), a driver has, by this return motion, a feeling that the blocking bar is coming toward the driver (an image of a door shut in the driver's face). The pass blocking apparatus disclosed in JP2011-058333A is intended to provide a mechanism for avoiding this situation in such a manner that the blocking bar is prevented from returning to the closed position by means of the biasing force. The pass blocking apparatus (1) of JP2011-058333A, for this purpose, comprises a vertically swingable blocking bar (6), a hinge connection unit (3*b*-3*f*) for connecting the blocking bar (6) to a driving shaft (3*a*), a biasing unit (10), and a resistance unit (20). The blocking bar (6) extends perpendicularly to the axis of the driving shaft (3*a*) and is vertically swung by rotation of the driving shaft (3*a*). The hinge connection unit (3*b*-3*f*) permits the blocking bar (6) to be horizontally swung to an evacuation position. The biasing unit (10) applies a biasing force to the blocking bar (6) for swinging the blocking bar (6) toward the evacuation position. The resistance unit (20) provides the blocking bar (6) with a resistance force for holding the blocking bar (6) in a closed position against the biasing force.

In this pass blocking apparatus (1), the blocking bar (6) is biased toward the evacuation position, and therefore the blocking bar (6), which has been horizontally swung due to vehicle contact or other reasons, is prevented from bouncing back. This is because the biasing force is applied in the opposite direction to that of JP2000-043729A. Since the blocking bar (6) is normally held in a vertical swing mode by means of the resistance force by the resistance unit (20), when a force more than the resistance force is applied to the blocking bar (6), the blocking bar (6) is released and automatically swung to the evacuation position by means of the biasing force. In this way, the biasing force is not used for the return of the blocking bar (6) to the closed position, and the problem above is solved by this mechanism.

A specific example of this pass blocking apparatus is shown in FIGS. 1-5B attached hereto. The illustrated pass blocking apparatus 1 comprises a blocking bar driving device 3, a control unit 4, and a blocking bar return device 5, which all are housed in a box-like housing 2 covering the whole. These blocking bar driving device 3, control unit 4 and blocking bar return device 5 can be installed by use of columnar supports and frames inside the housing 2. The blocking bar driving device 3 comprises a motor for rotating a driving shaft 3*a* (refer to JP2011-058333A). The blocking bar return device 5 comprises a motor for moving forward and backward a reciprocal arm 5*f* (refer to JP2011-058333A). The control unit 4 is an electrical control unit for controlling the motors of the blocking bar device 3 and blocking bar return device 5.

The blocking bar 6 is attached via a bar holder 3*b* such that the blocking bar 6 extends perpendicularly to the axis of the driving shaft 3*a*. This blocking bar 6 can be vertically swung by rotation of the driving shaft 3 between an open position (upright state, shown by the dotted line in FIG. 1A) and a closed position (transverse state, shown by the solid line in FIG. 1A). The bar holder 3*b* is attached in hinge connection to the driving shaft 3*a* (a hinge connection unit 3*c*-3*f*), and this permits the blocking bar 6 attached to the bar holder 3*b* to be horizontally swung by about 90 degrees to evacuate to an evacuation position (shown by the dotted line in FIG. 1B) when a vehicle collides with the blocking bar 6 in the closed position.

For the swing of the blocking bar 6 to the evacuation position, the pass blocking apparatus 1 has a biasing unit 10 and a resistance unit 20. FIG. 2 shows the configuration of the biasing unit 10 and resistance unit 20. FIG. 2A is a plan view, FIG. 2B is a cross-sectional view along the line B-B, and FIG. 2C is a cross-sectional view along the line B-B'.

The biasing unit 10 is disposed on the outer surface of a pivot support 3*d* to apply a biasing force to the blocking bar 6 for swinging the blocking bar 6 toward the evacuation position. A hinge pivot 3*e* of this illustrated example is provided with a grasping projection 3*e*-*a* on its top end. The grasping projection 3*e*-*a* has a slit for grasping the inner end 11*a* of a flat spiral spring 11. The outer end 11*b* of the flat spiral spring 11 is fixed by means of screwing, clamping or other methods to the inside wall of a cover 12 which is provided for housing the grasping projection 3*e*-*a* and the flat spiral spring 11. The cover 12 is fixed to the pivot support 3*d* by means of four bolts 13, and this fixation results in fixing the outer end 11*b* of the flat spiral spring 11 to the pivot support 3*d*. Consequently, the flat spiral spring 11 provides constantly the biasing force for swinging the hinge pivot 3*e* in one direction (i.e., the direction toward the evacuation position to which the blocking bar 6 is swung).

The resistance unit 20 provides a resistance force for holding the blocking bar 6 in the closed position against the biasing force by the biasing unit 10. As shown in FIG. 2C, the resistance unit 20 comprises a plunger 21, a coil spring 22, and a stud bolt 23 with a hexagon socket for adjusting the resistance force. The plunger 21 and the coil spring 22 are inserted into a through hole formed in the pivot support 3*d*, and then the stud bolt 23 is clenched thereinto. When the blocking bar 6 is in the vertically-swingable mode as shown by the solid line in FIG. 1, the head of the plunger 21 is engaged with a concave 3*c*-*a* formed on the surface of the base 3*c* of the bar holder 3*b*. Consequently, it is required to release the engagement of the plunger 22 and the concave 3*c*-*a* against the coil spring 22 when the blocking bar 6 starts to swing horizontally from the closed position. The resilient force by the coil spring 22 therefore acts as the resistance force that holds normally the blocking bar 6 in the vertically-swingable mode.

When a vehicle contacts with the blocking bar 6, a force exceeding the resistance force by the resistance unit 20 is applied to the blocking bar 6. The blocking bar 6 is thereby swung, and this swing causes the engagement of the plunger 21 and the concave 3*c-a* to be released (FIG. 2A). Since the hold by the resistance unit 20 is thereby cancelled, the blocking bar 6 is horizontally swung to the evacuation position depending on the biasing force by the biasing unit 10 (FIG. 2A). This means that the blocking bar 6 does not bounce back to the closed position because of the bias toward the evacuation position that is applied by means of the biasing unit 10. Conversely, when a force exceeding the resistance force causes the hold by the resistance unit 20 to be cancelled, the blocking bar 6 starts to swing and then swings automatically to the evacuation position depending on the biasing force.

FIGS. 3-5 show the operation of the pass blocking apparatus 1 for returning the blocking bar 6 from the evacuation position to the open position. The blocking bar 6 in the evacuation position is upward swung and pushed back by means of the blocking bar return device 5. For this operation, the reciprocal arm 5*f* of the blocking bar return device 5 extends to a position under the pivot support 3*d* of the driving shaft 3*a*. In another example, the blocking bar return device 5 can be mounted on the bottom of a base frame 1*b*, i.e., under the blocking bar driving device 3.

When the blocking bar 6 is horizontally swung from the closed position to the evacuation position due to vehicle contact or other reasons (FIG. 3), a sensor detects this swing motion and a lamp 2*a* (FIG. 1) is turned on. When a switch 2*b* (FIG. 1) is then operated, the blocking bar driving device 3 rotates the driving shaft 3*a* to the position corresponding to the open position of the blocking bar 6 (FIG. 4). In particular, for the purpose of returning upward the bar holder 3*b* toward the open position, the blocking bar driving device 3 rotates clockwise the driving shaft 3*a* by an angle of about 90 degrees. At this position, the hinge connection base 3*c* and the pivot support 3*d* can be folded upward.

According to this rotation of the driving shaft 3*a*, the orientation of a projection 31, which is projected diagonally backward from the hinge connection base 3*c*, is changed from a lateral direction to a downward direction, and then the projection 31 is positioned at the engageable position with the reciprocal arm 5*f*. In this manner, after the rotation of the driving shaft 3*a* to the position corresponding to the open position of the blocking bar 6, while the motor 5*b* of the blocking bar return device 5 moves the reciprocal arm 5*f* forward, the reciprocal arm 5*f* is in contact with the projection 31 and pushes out the projection 31 according to the forward motion (FIG. 5). The bar holder 3*b* is thereby swung upward to the open position, and at the same time, the blocking bar 6 in the evacuation position is pushed back in the vertically-swingable mode and returned to the open position by means of the forward motion of the reciprocal arm 5*f*. In this way, the blocking bar 6 is upward swung from the evacuation position and returned to the open position, and after this return, the blocking bar 6 is vertically swung to the closed position according to a normal swing operation. The feeling that the blocking bar 6 is coming toward a vehicle is avoided by this operation.

SUMMARY

The pass blocking apparatus described above has the merit as mentioned above with respect to the return of the blocking bar from the evacuation position. However, for example, in the situation that a number of vehicles are bumper-to-bumper on ETC lanes due to a traffic jam, the pass blocking apparatus still has room for improvement. In particular, there is a potential for improvement with respect to the situation that in bumper-to-bumper traffic a truck passes through an ETC gate following a sedan.

In this case, the blocking bar is vertically swung from the open position to the closed position after the sedan (followed by the truck) passes through the ETC gate, and subsequently, this blocking bar starts to vertically swing from the closed position to the open position for permitting the following truck to pass through the ETC gate. In this situation, since there is only a slight distance between two vehicles due to the traffic jam, the truck may already reach the blocking bar. Its front face therefore lies close to the blocking bar which is swung for permitting the truck to pass through the ETC gate. Consequently, this swung blocking bar is stopped by contact with the side view mirrors of the truck, because the side view mirrors (especially, the left side mirror) of the truck is in general projected forward. This causes damage to the blocking bar.

The invention is directed to this problem, and intended to provide a mechanism for permitting the intentional release of the blocking bar from the closed position to the evacuation position as necessary.

In an aspect of the invention, a pass blocking apparatus is provided. This pass blocking apparatus comprises a blocking bar extending perpendicularly to the axis of a driving shaft, the blocking bar being vertically swung by rotation of the driving shaft;

a hinge connection unit for connecting the blocking bar to the driving shaft, the hinge connection unit permitting the blocking bar to be horizontally swung from a closed position to an evacuation position;

a biasing unit for applying a biasing force to the blocking bar, wherein the blocking bar can be swung toward the evacuation position depending on the biasing force; and a resistance unit for providing a resistance force for holding the blocking bar in the closed position against the biasing force, wherein the resistance unit includes an electromagnetic device and a magnetic material, and is configured to generate the resistance force from a magnetic force by the electromagnetic device that attracts the magnetic material, wherein the pass blocking apparatus further comprises a control unit which is configured to control electricity to the electromagnetic device.

The pass blocking apparatus according to the invention may include a power supply component which is capable of supplying electrical power at different levels to the electromagnetic device. The resistance force can be adjusted by means of the power switching of the power supply component.

The control unit may be configured to supply electrical power with reversed polarity to the electromagnetic device when controlling the electricity to the electromagnetic device in order to cancel the resistance force. In this embodiment, the power supply component is further configured to supply the electrical power with reversed polarity to the electromagnetic device.

DETAILED DESCRIPTION

Figure 3A:
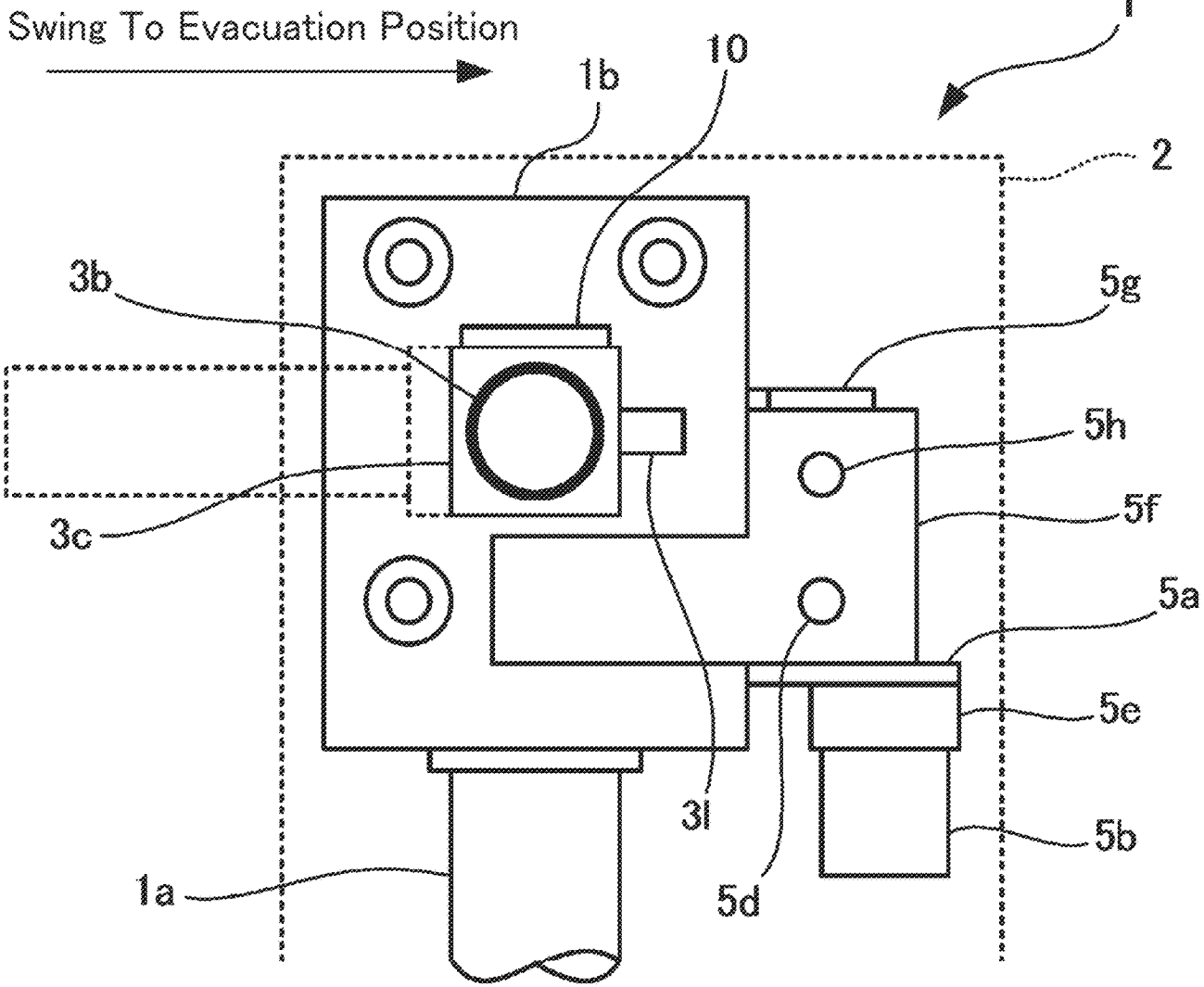
FIGS. 3A and 3B show the swing motion of the blocking bar to an evacuation position, with regard to a method for returning the blocking bar from an evacuation position to an open position.
Figure 3B:
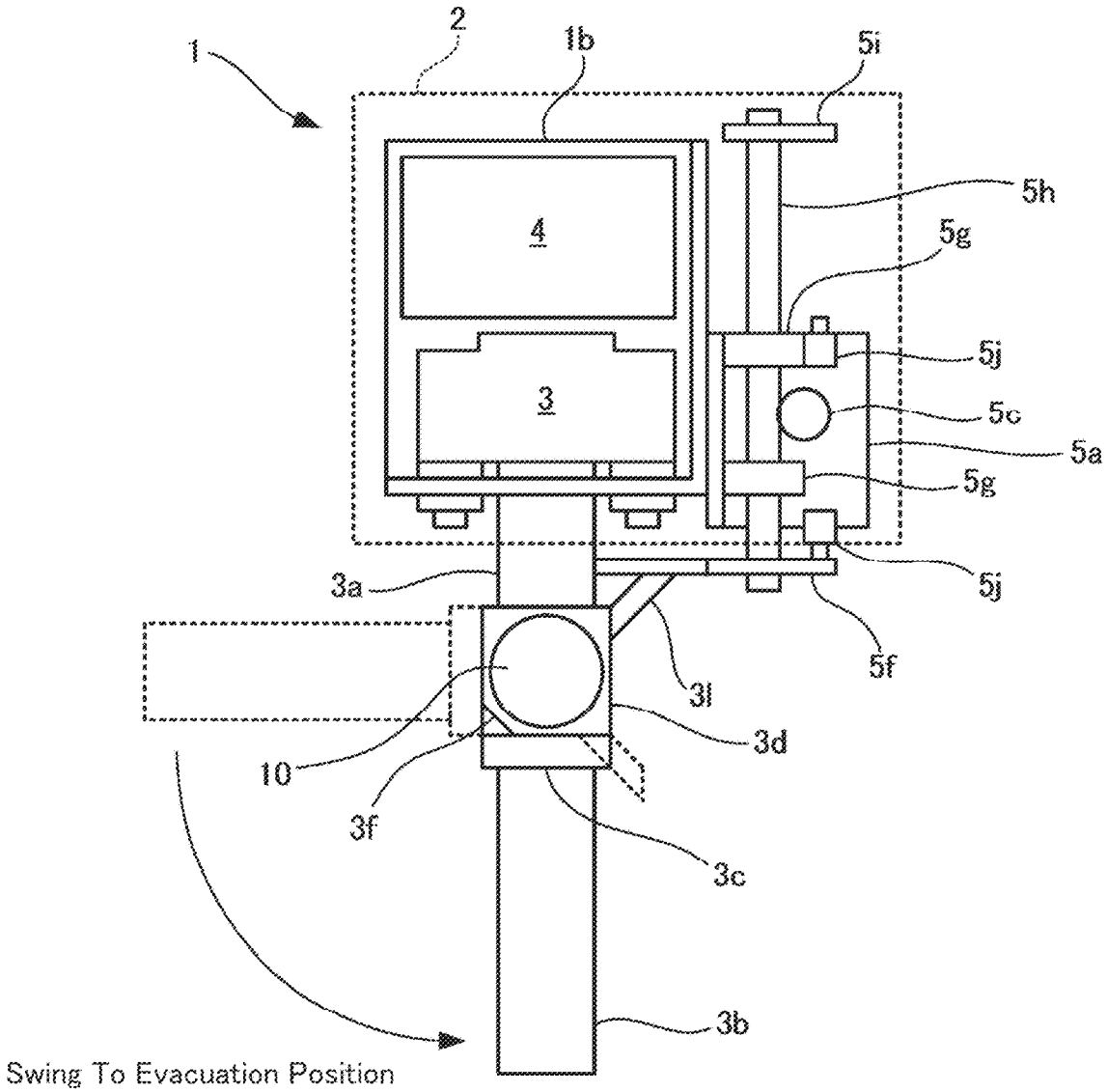
Figure 4A:
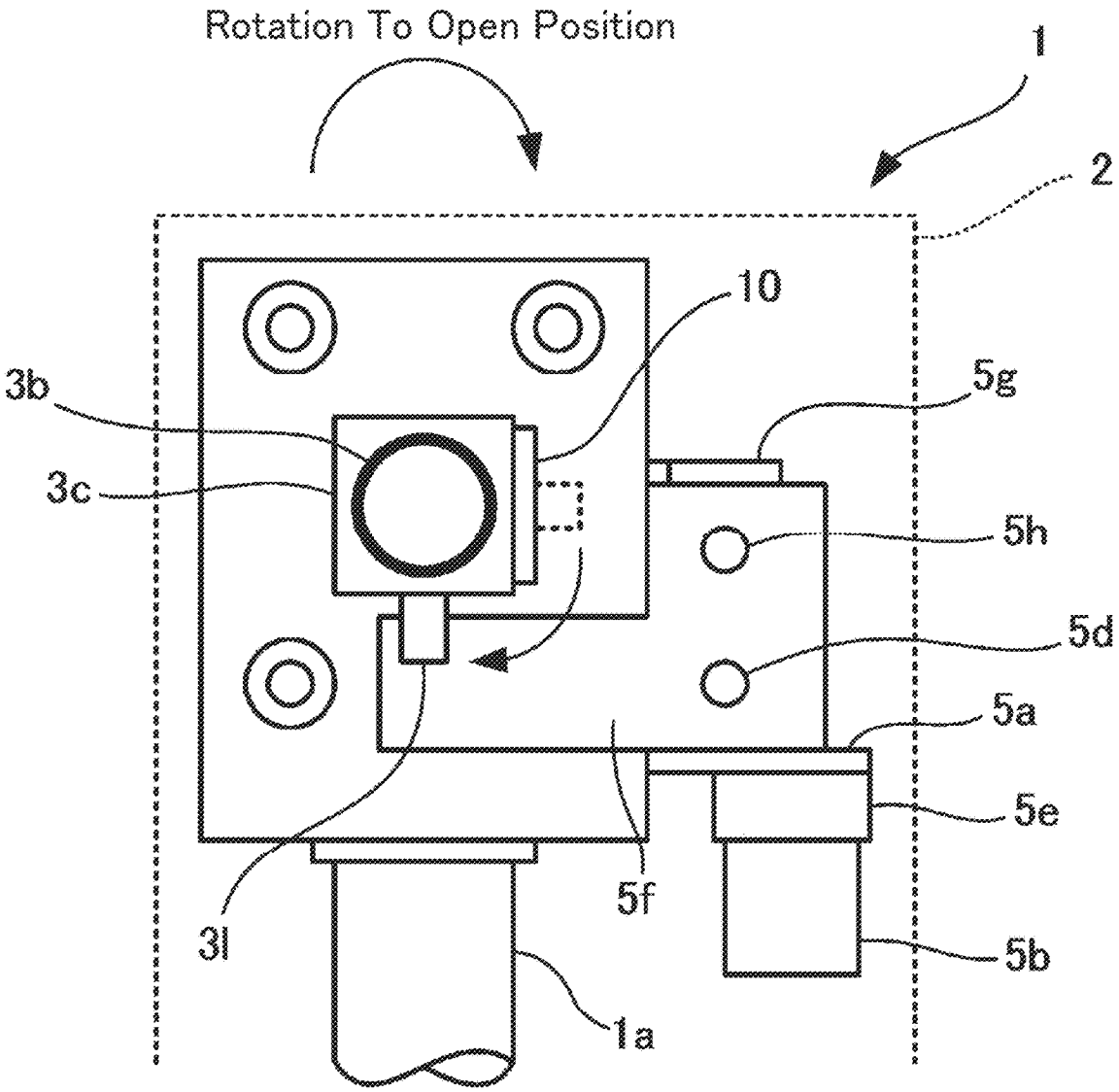
FIGS. 4A and 4B show the rotation of the driving shaft to the position corresponding to the open position of the blocking bar, with regard to the method for returning the blocking bar from an evacuation position to an open position.
Figure 4B:
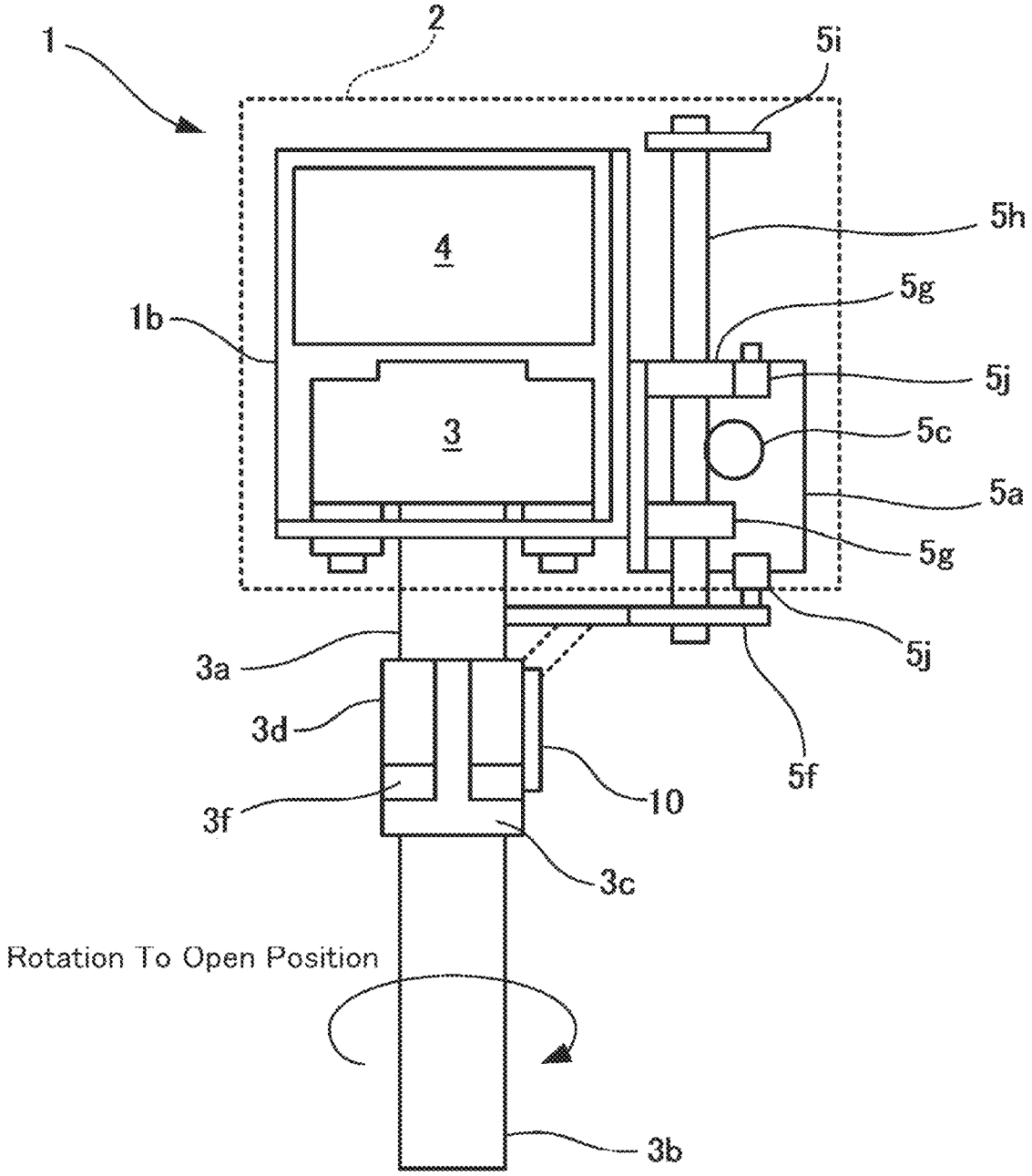
Figure 5A:
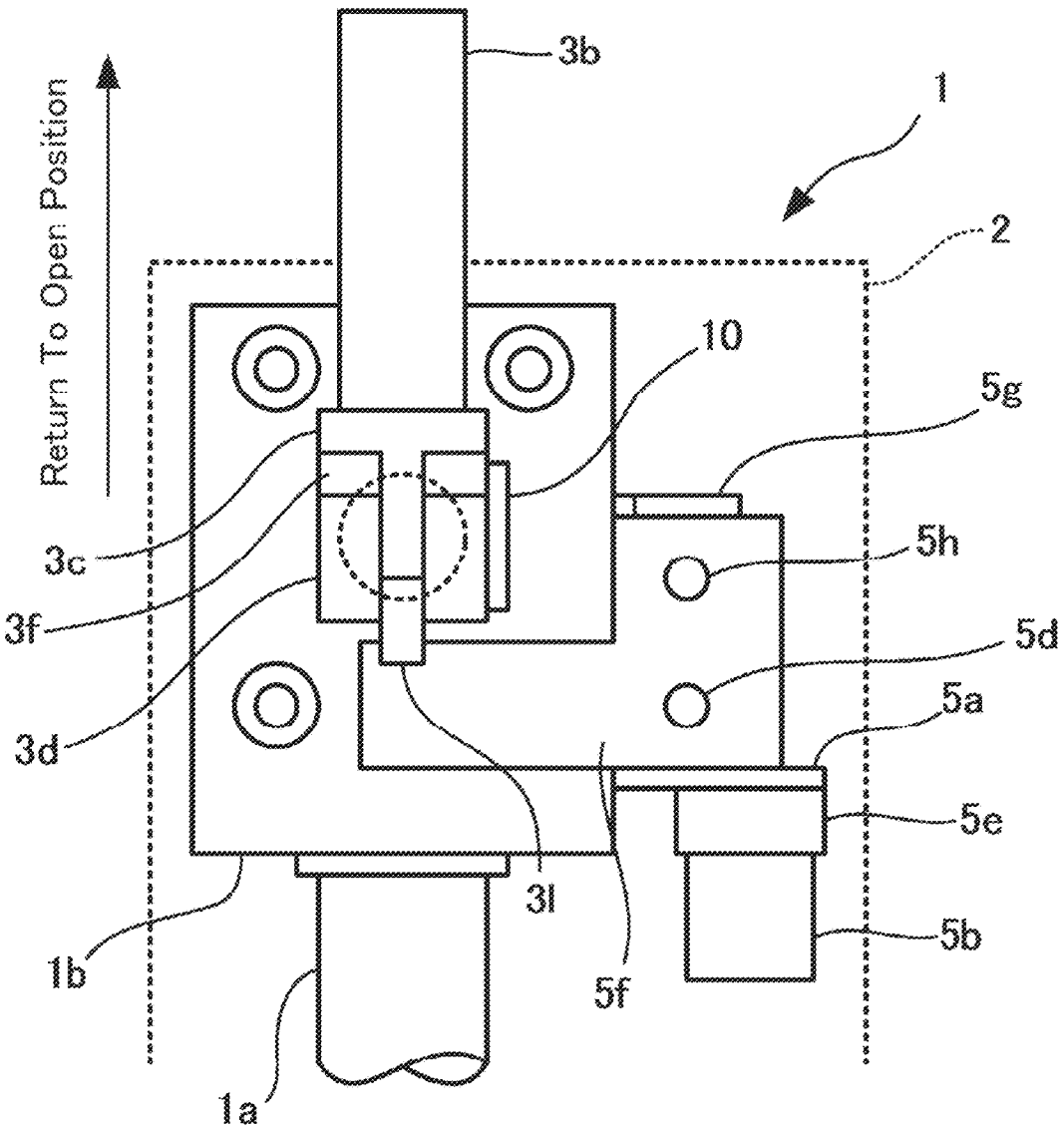
FIGS. 5A and 5B show the return of the blocking bar from the evacuation position to the open position, with regard to the method for returning the blocking bar from an evacuation position to an open position.
Figure 5B:
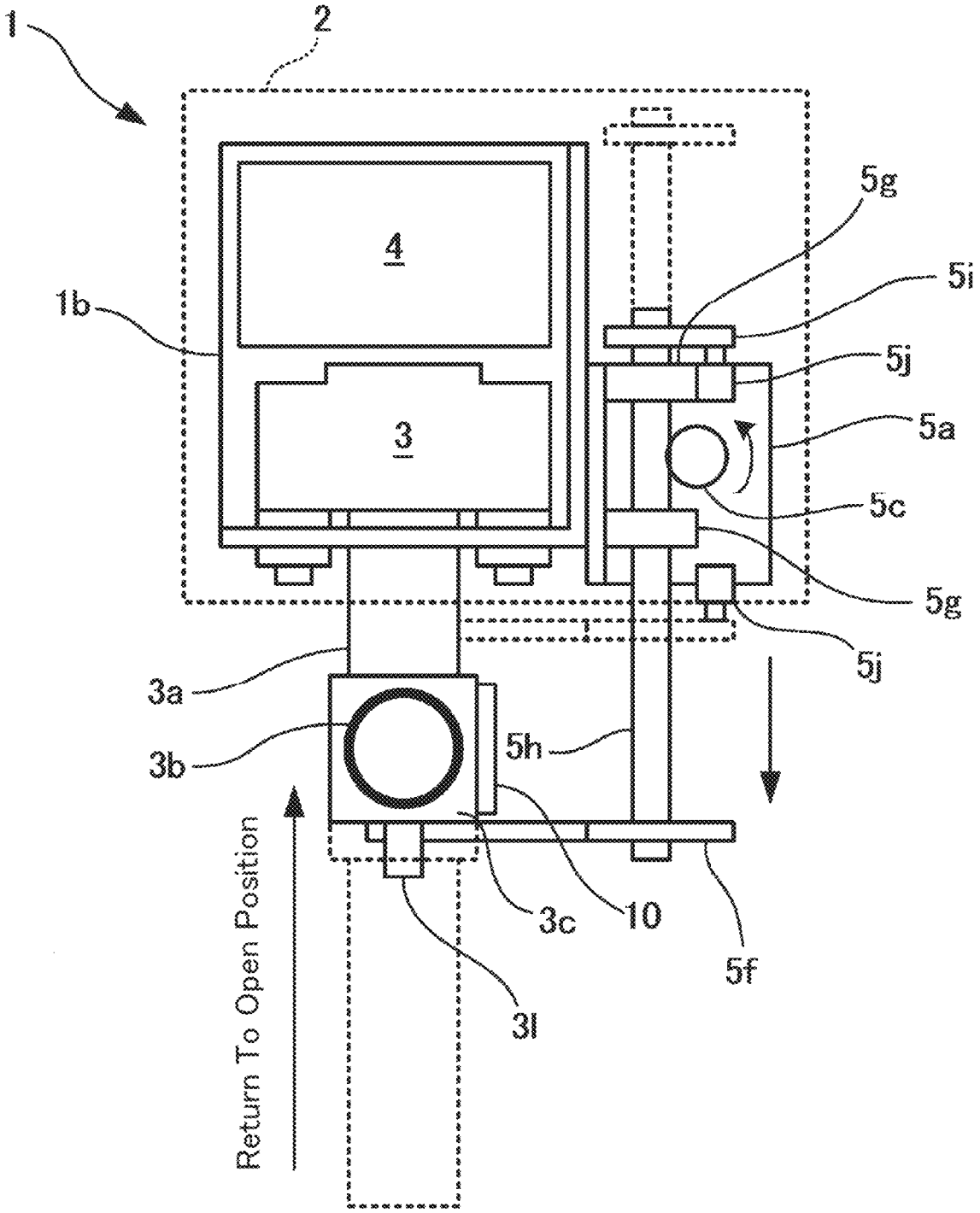
Figure 6A:
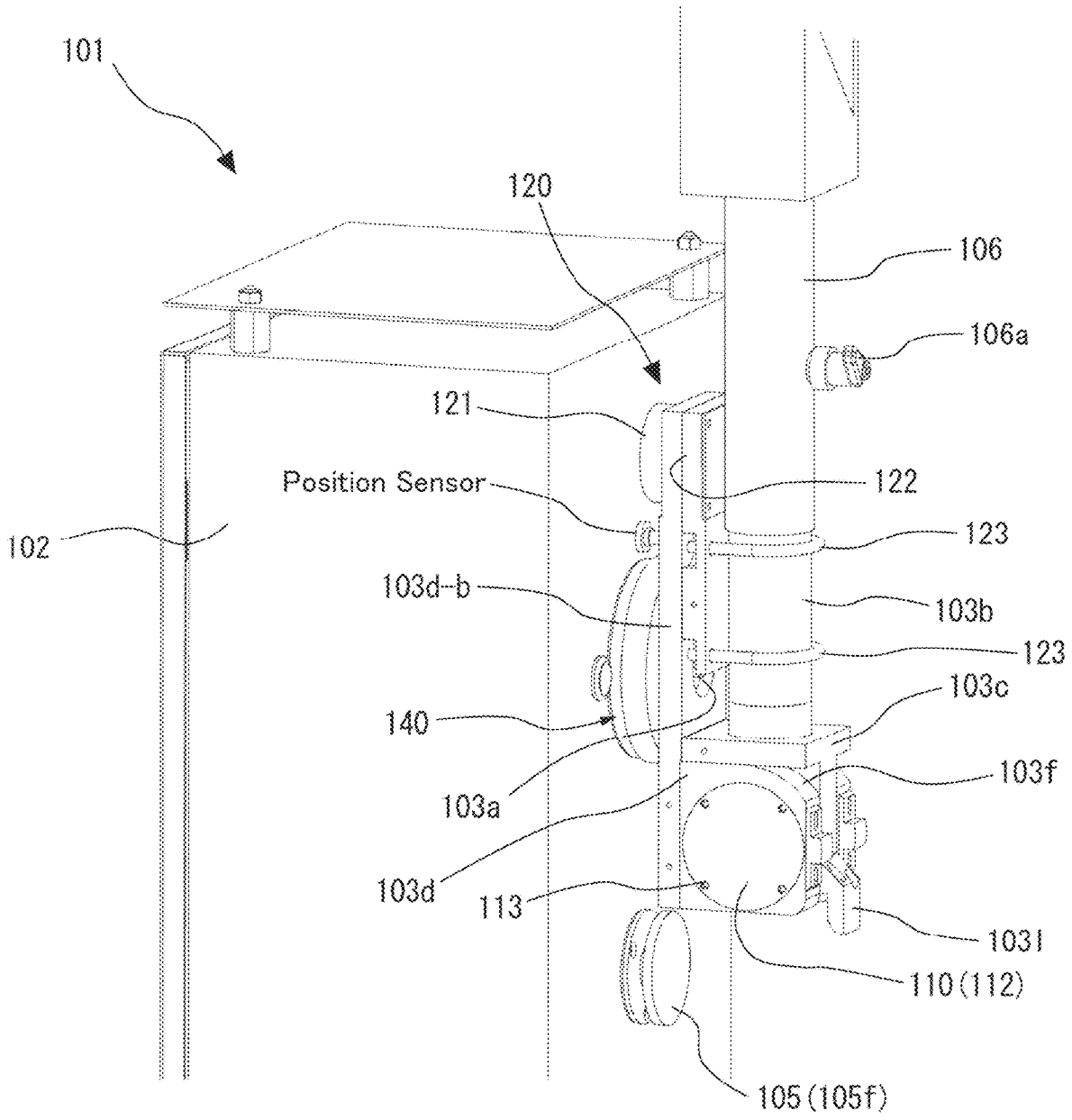
FIGS. 6A and 6B show a resistance unit according to an embodiment of the invention.
Figure 6B:
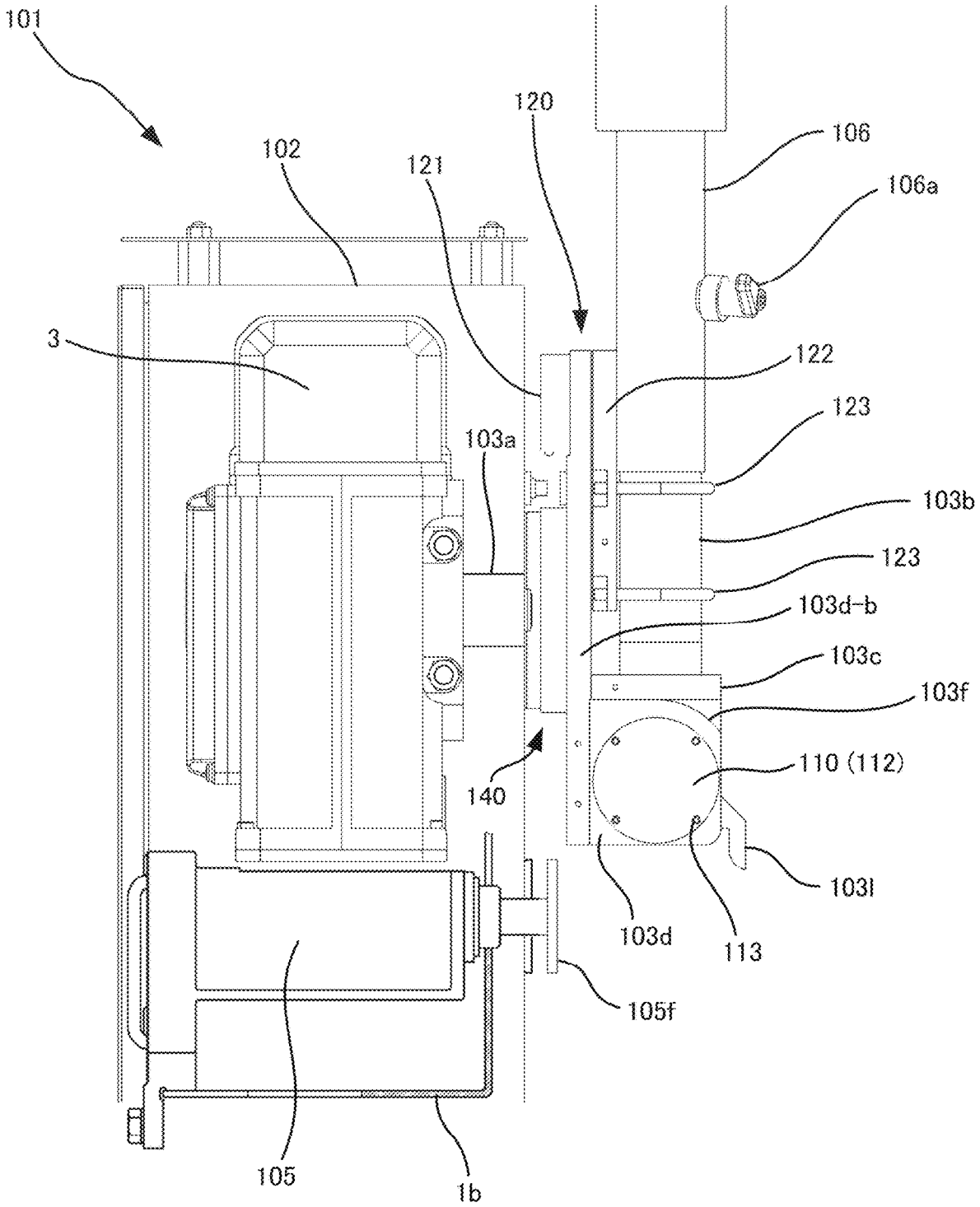

FIGS. 6A and 6B shows a relevant part of a pass blocking apparatus according to an embodiment of the invention. FIG. 6A is a perspective view for showing the external arrangement and FIG. 6B is a transparent view for showing the internal arrangement inside a housing. The pass blocking apparatus 101 has the housing 102 which houses a blocking bar driving device 3, a control unit 4, and a blocking bar return device 105, as in the apparatus shown in FIGS. 1 and 3-5 (in more detail, refer to JP2011-058333A). In this embodiment, the blocking bar return device 105 is mounted on the bottom of a base frame 1*b* inside the housing 102, i.e., arranged under the blocking bar driving device 3. A reciprocal arm 105*f* is accordingly formed in a disk shape instead of the laterally extended form as shown in FIGS. 3-5. This reciprocal arm 105*f* is reciprocally moved under a driving shaft 103*a*. In this embodiment, the control unit 4 is arranged with a power unit in the bottom of the housing 102 (not shown in the drawings).

The driving shaft 103*a* extends from the blocking bar driving device 3 within the housing 102 and projects outside the housing 102. A bar holder 103*b* is connected in a hinged manner to the driving shaft 103*a*. A blocking bar 106 is attached in a detachable manner to the bar holder 103*b*. The blocking bar 106, as illustrated in an open position, comprises an aluminum pipe covered with a urethane cover or the like which is painted in a red and white striped pattern, for example. One end of the pipe is inserted into the bar holder 103 and then fixed in the bar holder 103*a* by means of the rotary operation of a fixing lever 106*a* for screwing a fixing screw. The bar holder 103*b* includes a base 103*c* for hinge connection.

A hinge connection unit connects between the driving shaft 103*a* and the bar holder 103*b* as well as permitting the blocking bar 106 to be horizontally swung from a closed position to an evacuation position. The base 103*c* and a pivot support 103*d* are main components of the hinge connection unit. The base 103*c* of the bar holder 103*b* has a T-shaped cross-section, and this base 103*c* is wedged into the pivot support 103*d* having a C-shaped cross-section. The pivot support 103*d* is secured to the driving shaft 103*a*. A hinge pivot 103*e* (shown in FIG. 7) is secured to the base 103*a* and extends laterally (in the open position shown in FIGS. 6 and 7) from the flat face part of the base 103*c* wedged into the pivot support 103*d*. The hinge pivot 103*e* secured to the base 103*c* is rotatably supported by the pivot holes of the pivot support 103*d*. The pivot support 103*d* has almost a square shape in the top view thereof, in which one corner 103*f* of the square shape is chamfered. The base 103*c* can be swung around the hinge pivot 103*e* in a range of about 90 degrees across the chamfered corner 103*f*.

Figure 1A:
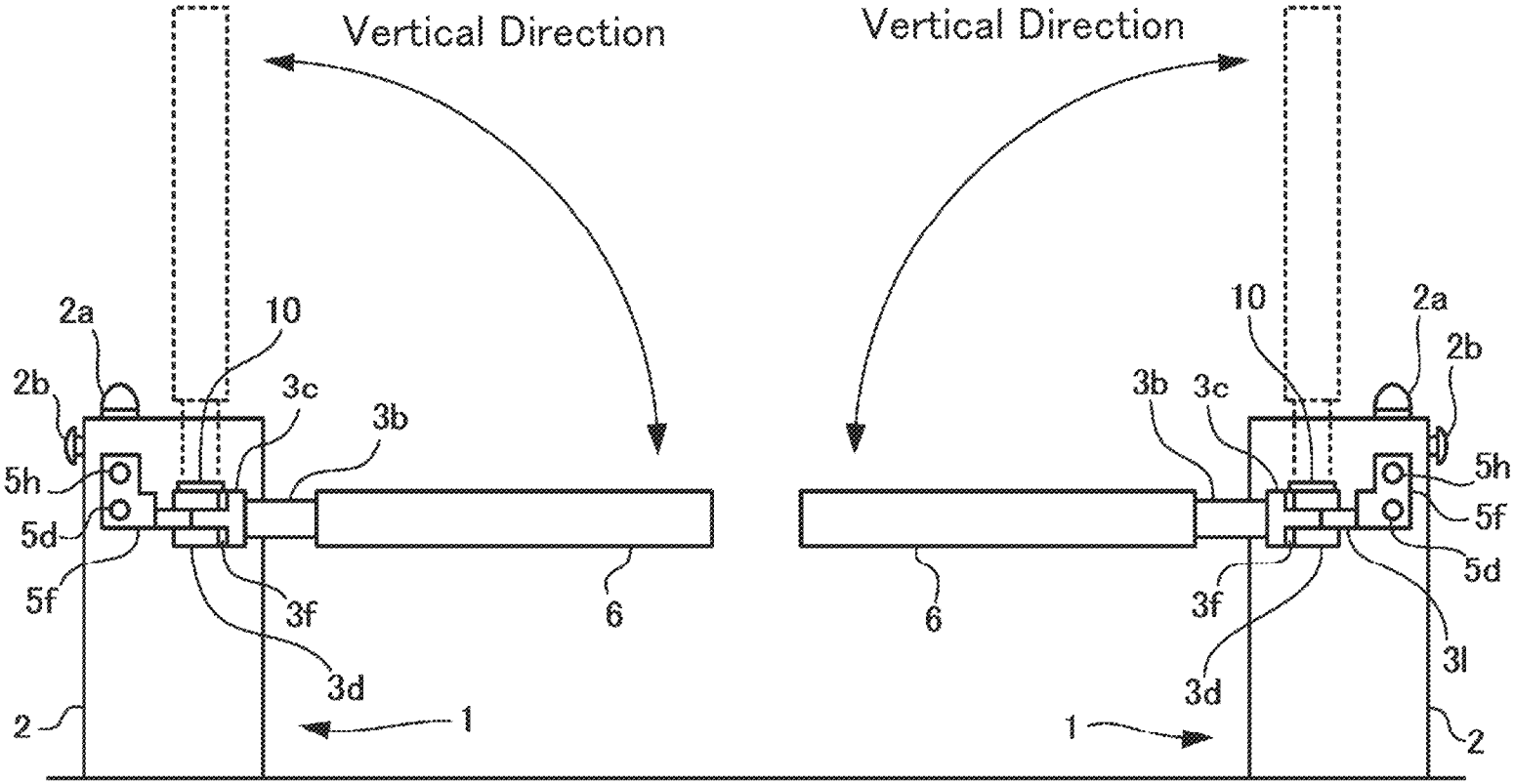
FIG. 1A is a back view (in relation to a driver) of a pair of pass blocking apparatuses which are installed at an ETC lane, according to an embodiment of the invention.
Figure 1B:
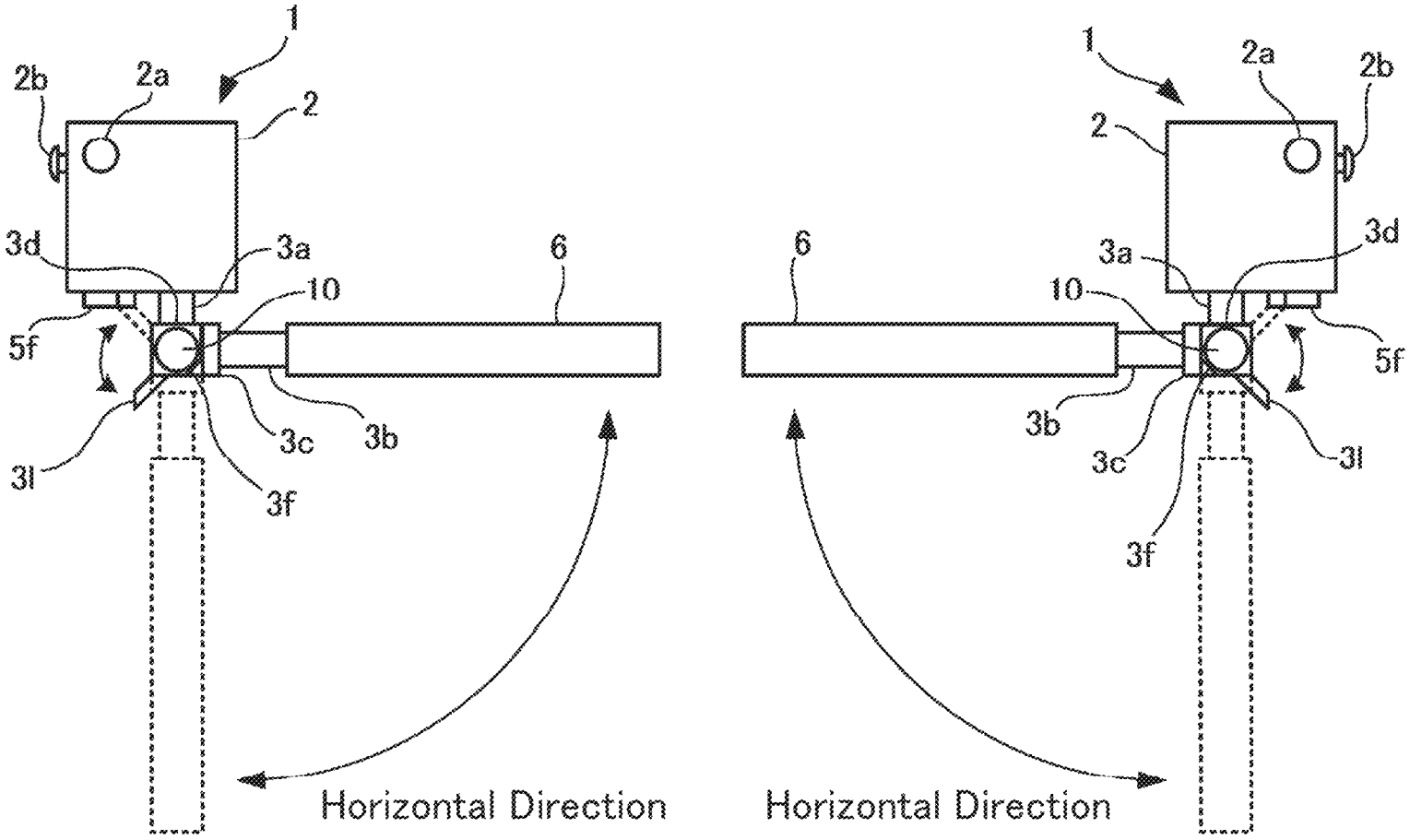
FIG. 1B is a top view of the pair of pass blocking apparatuses as shown in FIG. 1A.

The blocking bar 106, which is attached via the bar holder 103*b* and extends perpendicular to the axis of the driving shaft 103*a*, is vertically swung according to the rotation of the driving shaft 103*a* between the open position (upright state, shown by the dotted line in FIG. 1A) and the closed position (transverse state, shown by the solid line in FIG. 1A). In addition, the hinged connection between the bar holder 103*b* and the driving shaft 103*a* permits the blocking bar 106 attached to the bar holder 103*b* to be horizontally swung by about 90 degrees to the evacuation position (shown by the dotted line in FIG. 1B) when a vehicle collides with the blocking bar 106 in the closed position.

For the swing of the blocking bar 106 to the evacuation position, the pass blocking apparatus 101 is provided with a biasing unit 110 and a resistance unit 120.

Figure 2A:
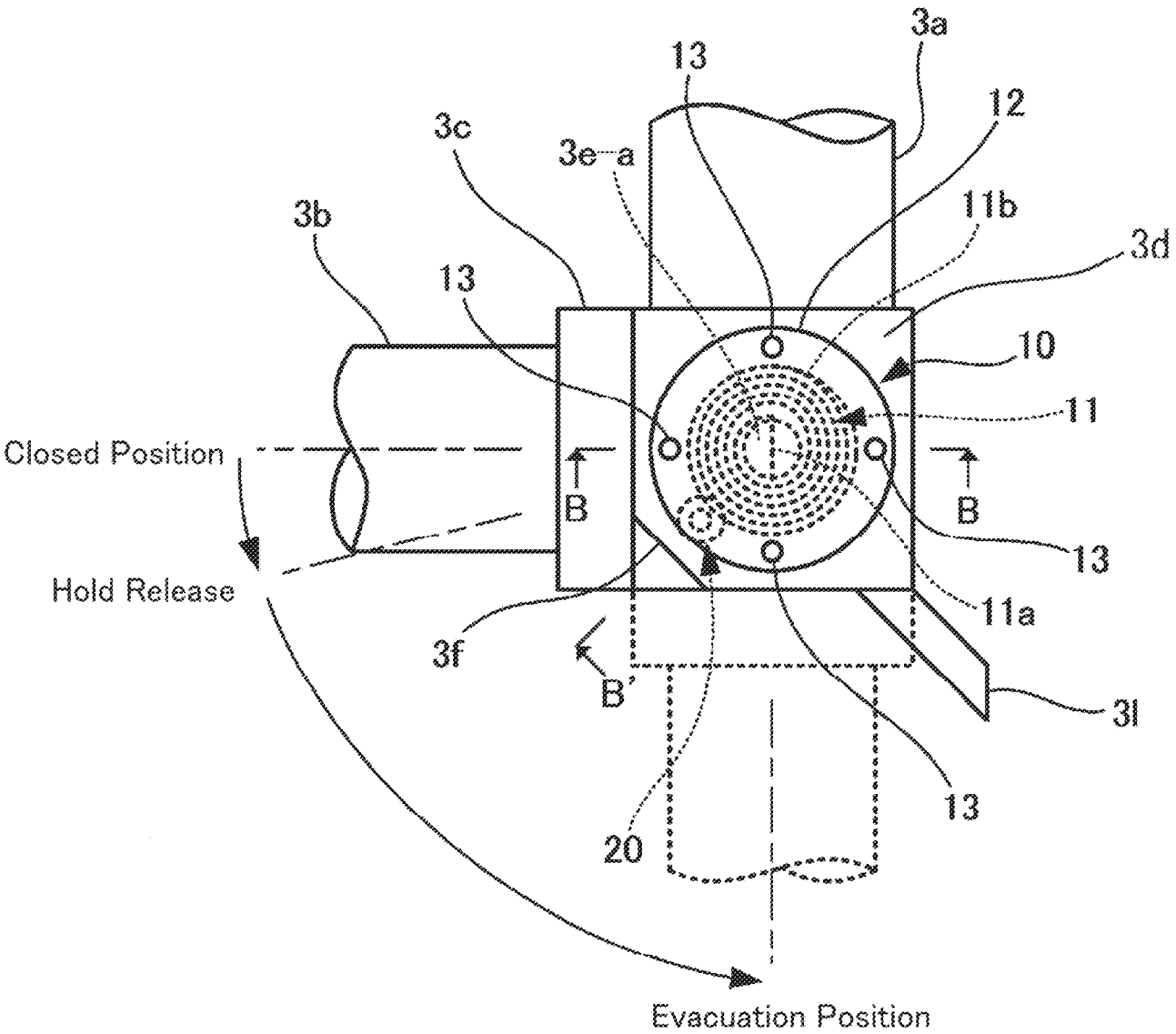
FIGS. 2A-2C show the details of a connection between a driving shaft and a blocking bar.
Figure 2B:
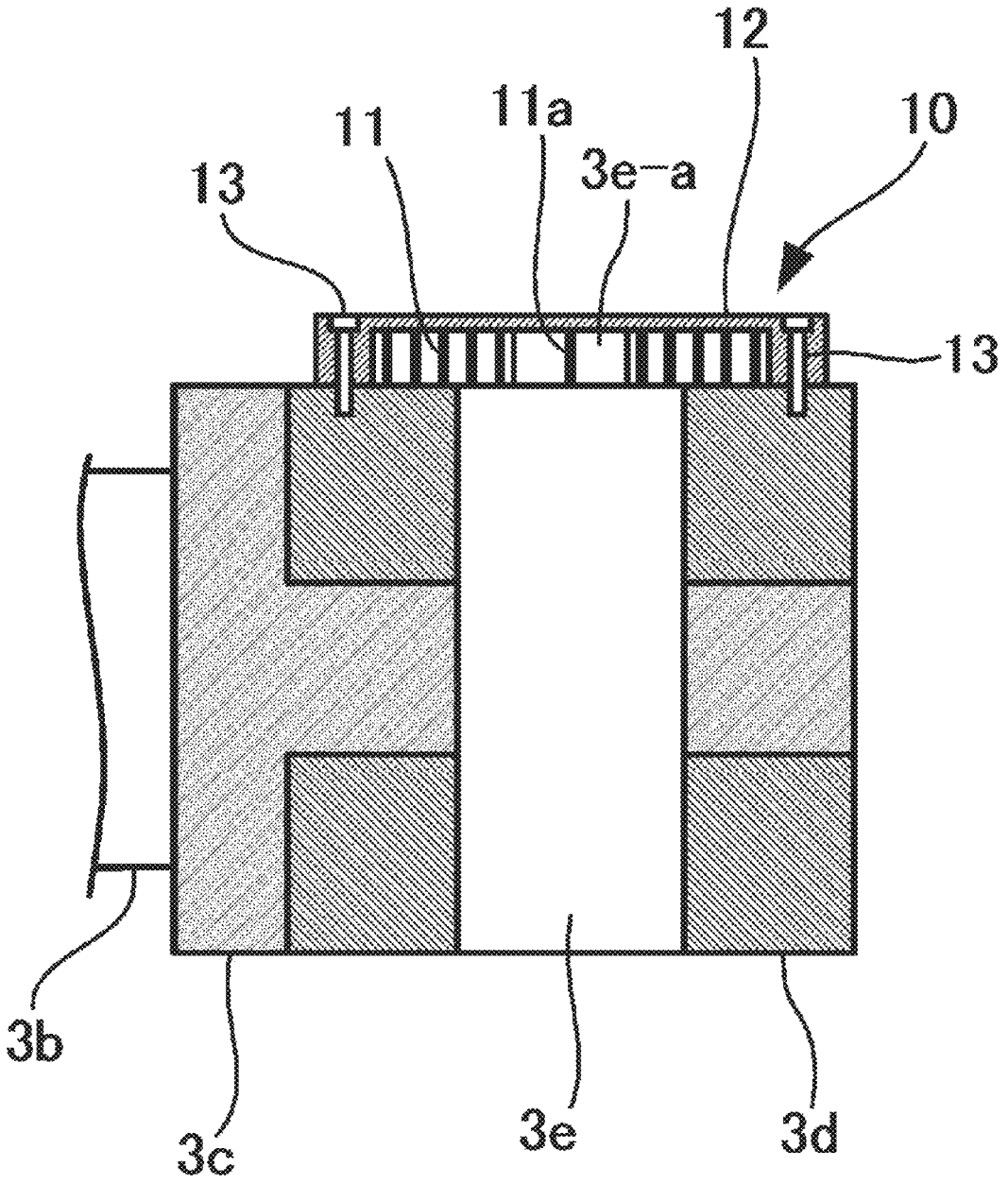
Figure 2C:
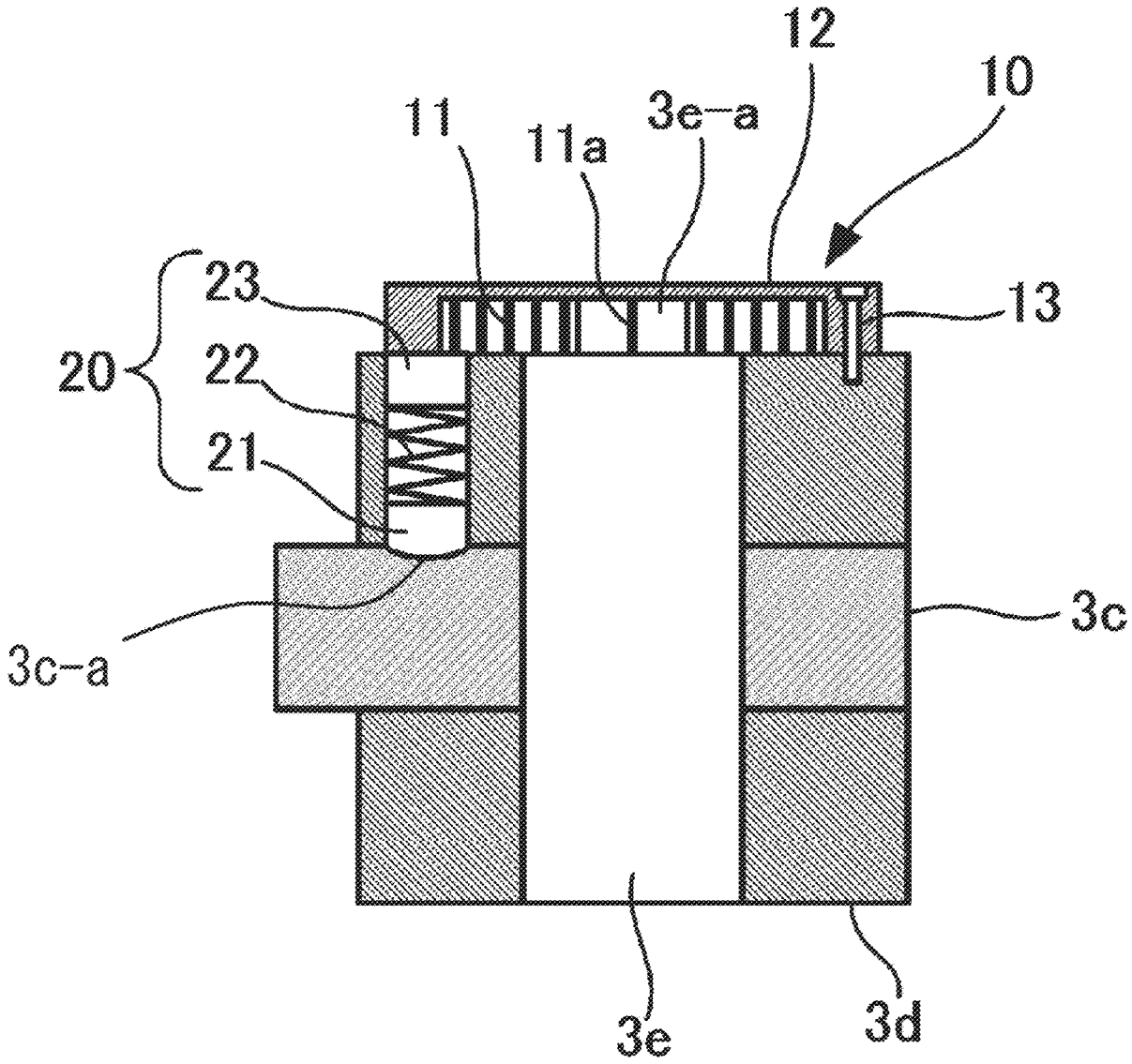
Figure 7:
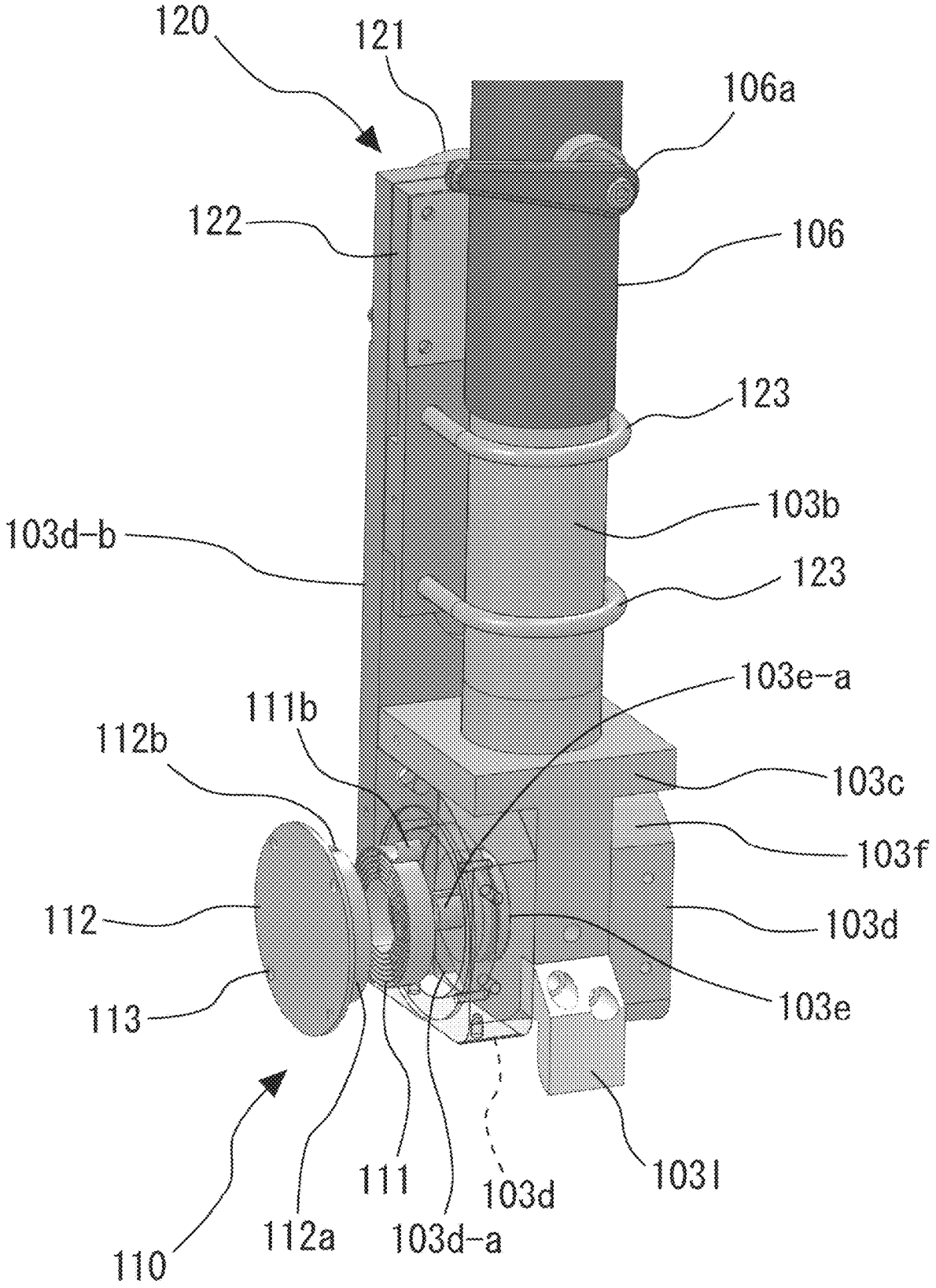
FIG. 7 is a partially disassembled view of a biasing unit (flat spiral spring type) according to an embodiment of the invention.
Figure 8:
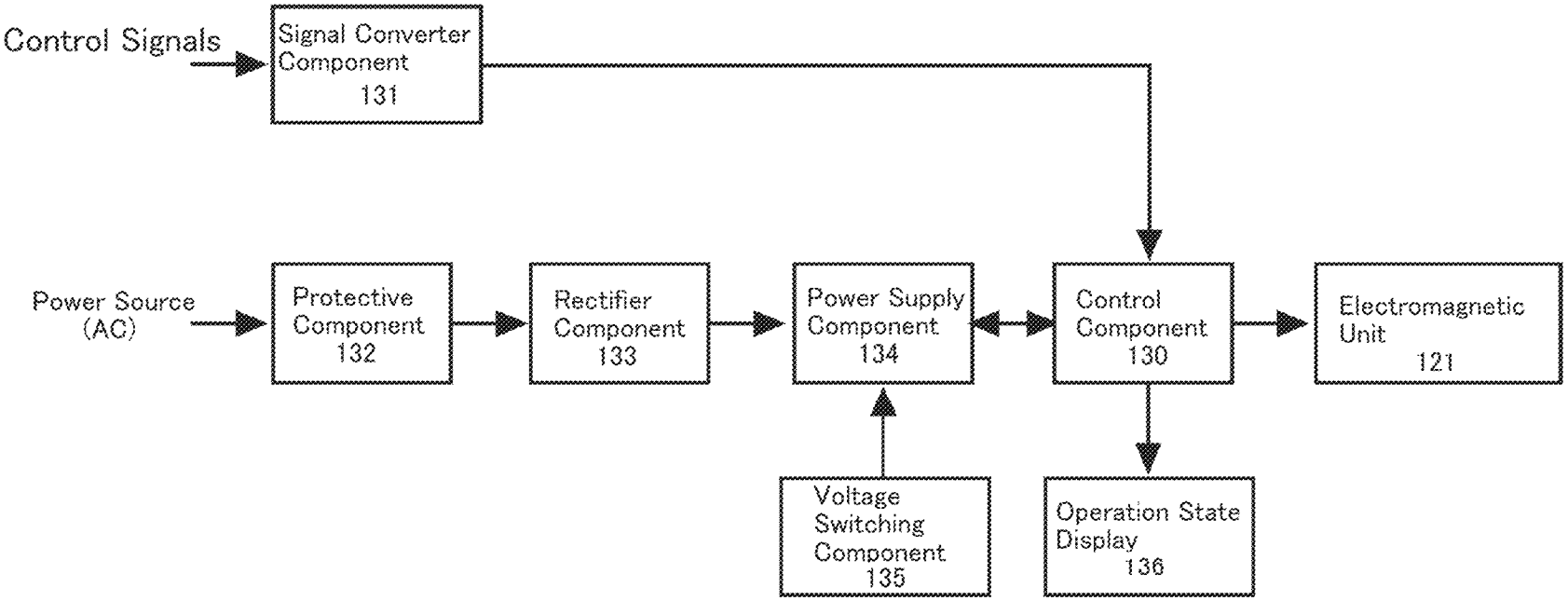
FIG. 8 shows a control unit for controlling the resistance unit, according to an embodiment of the invention.

The biasing unit 110 applies a biasing force to the blocking bar 106 for swinging the blocking bar 106 to the evacuation position. As shown in FIG. 7, the biasing unit 110 is housed within a housing concave 103*d-a* formed in the pivot support 103*d*. As illustrated, the hinge pivot 103*e* has a grasping projection 103*e-a* on the end face. This grasping projection 103*e-a* projects into the housing concave 103*d-a*. The grasping projection 103*e-a* is provided with a slit for grasping the inner end of a flat spiral spring 111 (also refer to FIG. 2). The flat spiral spring 111 is housed within the housing concave 103*d-e*. The housing concave 103*d-e* that has housed the flat spiral spring 111 is closed with a cover 112. The cover 112 is provided with a flange 112*a* on the inside, which surrounds the flat spiral spring 111. The flange 112*a* has a slit 112*b* for grasping the outer end 111*b* of the flat spiral spring 111. The cover 112 is fixed to the pivot support 103*d* by means of four bolts 113, and consequently, the outer end 111*b* of the flat spiral spring 111 is fixed with respect to the pivot support 103*d*. This flat spiral spring 111 provides constantly a biasing force for rotating the hinge pivot 103*e* in one direction (for swinging the blocking bar 106 toward the evacuation position). In another embodiment, a coil spring may be used instead of the flat spiral spring 111, of which one end is engaged with a projection 103*e-a* that is arranged at an offset position with respect to the pivot center, and the other end is fixed to the cover 112. However, in view of a simple configuration, the flat spiral spring 111 is suitable for this unit.

The resistance unit 120 provides a resistance force for holding the blocking bar 106 in the closed position against the biasing force by the biasing unit 110. In this embodiment, the pivot support 103*d* has an elongated base board 103*d-b* extending parallel to the bar holder 103*b*. The base board 103*d-b* is fixed substantially at its center to the driving shaft 103*a*. An electromagnetic device 121 of the resistance unit 120 is attached to the distal end extending from the central fixed part. This means that the electromagnetic device 121 is arranged at the shaft-fixation side of the hinge connection unit. At the same time, a board-like magnetic material 122 of the resistance unit 120 is attached by use of U-shaped bolts 123 to the bar holder 103*b* positioned parallel to the base board 103*d-b*, thereby facing the electromagnetic device 121. This means that the magnetic material 122, which is magnetically attracted to the electromagnetic device 121, is arranged at the bar side (swing side). In another embodiment, the arrangement of the electromagnetic device 121 and the magnetic material 122 may be reversed (i.e., the electromagnetic device arranged at the bar side and the magnetic material arranged at the shaft-fixation side). Alternatively, a magnetic bar holder or a magnetic base board may be used instead of the magnetic material 122. In an embodiment, the magnetic material 122 is made of ferrite-based or martensite-based stainless steel. The energized electromagnetic device 121 attracts magnetically the magnetic material 122, thereby generating the resistance force against the biasing force by the biasing unit 106. The vertical-swing mode of the blocking bar 106 is normally maintained by means of the resistance force.

When a vehicle collides with the blocking bar 106 in the closed position, the blocking bar 106 receives a force exceeding the resistance force by the resistance unit 120, i.e., the magnetic force by the electromagnetic device 121. The blocking bar 106 is released by this force from the held state by the resistance unit 120, and then horizontally swung by about 90 degrees to the evacuation position depending on the biasing force by the biasing unit 121. When the blocking bar 106 reaches the evacuation position in consequence of this evacuation swing, the blocking bar 106 in the evacuation position is detected by a sensor. An operator checks this sensor detection, and then operates a switch mounted on the housing 102 or a remote operation switch disposed in a waiting booth to activate the blocking bar return device 105 for returning the blocking bar 106 to the vertical-swing mode.

As an example, the blocking bar return device 5 as shown in FIGS. 3-5, which is the same as JP2011-058333A, is usable as the blocking bar return device 105. However, in this embodiment, the blocking bar return device 105 different from the blocking bar return device 5 in the mounted position. In particular, the blocking bar return device 105 is mounted on the outside or inside of the bottom of the base frame 1*b*. This means that the blocking bar return device 105 is positioned under the blocking bar driving device 103. With respect to this arrangement, a columnar support 1*a* as shown in the drawings can be used in the case of mounting the device 105 on the bottom inside, but in the case of mounting the device 105 on the bottom outside, another columnar support or frame, which is adapted to the arrangement of the blocking bar return device 105 on the bottom of the base frame 1*b*, is required instead of the illustrated columnar support 1*a*. Here, the blocking bar return device 105 is described with reference to the reference numbers used in FIGS. 3-5. In this example of the blocking bar return device 105, an L-shaped frame 5*a* is fixed at its side wall to the bottom of the base frame 1*b* by means of bolt fixation or welding. A motor 5*b*, a pinion gear 5*c* driven by the motor 5*b*, and a rack gear 5*d* moved forward and backward according to the pinion gear 5*c* are mounted on the frame 5*a* and constitute an actuator. The rack gear 5*d* of the blocking bar return device 105 is positioned under the driving shaft 103*a* (i.e., the position of the reciprocal arm 105*f* in FIG. 6A). In this example in which the side wall of the frame 5*a* is fixed to the bottom of the base frame 1*b*, a set of all components is rotated clockwise by 90 degrees. In the illustrated example in FIG. 6B, the blocking bar return device 105 is mounted on the inside of the bottom of the base frame 1*b*. In the blocking bar return device 105 of FIG. 6B, a set of the motor 5*b*, the pinion gear 5*c* and the rack gear 5*d* is assembled in one housing. This assembled blocking bar return device 105 is mounted on the bottom inside (upper side face) and positioned under the blocking bar driving device 3.

The motor 5*b* is provided with a decelerator 5*e* on its head and fixed to the frame 5*a*. The output shaft of the decelerator 5*e* passes through the frame 5*a* and projects into the opposite side. The pinion gear 5*c* is attached to the projected output shaft to engage with the rack gear 5*d*. The rod-like rack gear 5*d* extends parallel to the axis of the driving shaft 103*a*. The disk-like reciprocal arm 105*f* (FIG. 6) is attached to one end of the rack gear 5*d*. The rod-like rack gear 5*d* has teeth which are formed in the longitudinal direction by cutting, and is slidably supported by two bearing blocks 5*g* which are fixed to the frame 5*a*. The rack gear 5*d* can be thereby slid parallel to the axis of the driving shaft 103*a*. The two bearing blocks 5*g* are separately arranged from each other. The pinion gear 5*c* engages with the rack gear 5*d* between the two bearing blocks 5*g*. The rack gear 5*d* is moved forward and backward according to the reversible rotation of the pinion gear 5*c*. According to this reciprocal motion of the rack gear 5*d*, the reciprocal arm 105*f* attached to the rack gear 5*d* is moved forward and backward parallel to the axis of the driving shaft 103*a*. In this example, there is no need to provide a guide rod 5*h* for the blocking bar return device 105.

A plate 5*i* is attached to the other end of the rack gear 5*d*. This plate 5*i* pushes a limit switch 5*j* mounted on the frame 5*a* in the forward-motion-end position of the rack gear 5*d*. Another limit switch 5*j* is also mounted on the frame 5*a*. In other words, two limit switches 5*j* are arranged at the front and rear of the frame 5*a*. In the backward motion of the rack gear 5*d*, the front side limit switch 5*j* is pushed by the reciprocal arm 105*f* that have been moved to the backward-motion-end position, in order to stop the motor 5*b*. In other embodiments, the front side limit switch 5*j* may be omitted. In the forward motion of the rack gear 5*d*, the rear side limit switch 5*j* is pushed by the plate 5*i* that have been moved to the forward-motion-end position. This action triggers the switching of the rotation direction of the motor 5*b* from the normal rotation to the reverse rotation. In other embodiments, instead of the motor 5*b*, the actuator may comprise a hydraulic cylinder or a pneumatic cylinder in which the reciprocal arm is attached to its rod.

The reciprocal arm 105*f* moved forward according to the rack gear 5*d* is in contact with a projection 1031 which is projected diagonally backward from the hinge connection base 103*c*. The projection 1031 is thereby pushed out for the swing of the bar holder 103*b*. The blocking bar 106 is horizontally swung to the evacuation position due to collision with a vehicle (refer to FIG. 3). After this, according to the start of the return operation, the blocking bar driving device 3 rotates the driving shaft 103*a* to the position corresponding to the open position of the blocking bar 106 (refer to FIG. 4). In particular, the blocking bar driving device 3 rotates the driving shaft 103*a* clockwise by 90 degrees so that the base 103*c* and the pivot support 103*d* of the hinge connection unit are folded upward for the upward return of the bar holder 103*b* to the open position. As the result of this rotation of the driving shaft 103*a*, the projection 1031 is turned from the lateral position to the downward position at which the reciprocal arm 105*f* can contact with the projection 1031. After the rotation of the driving shaft 103*a* to the position corresponding to the open position of the blocking bar 106, the motor 5*b* of the blocking bar return device 105 is driven in a normal-rotation mode to move forward the reciprocal arm 105*f*. This moved reciprocal arm 105*f* is in contact with the projection 1031 to push out the projection 1031 (FIG. 5). According to this motion, the bar holder 103*b* is upward swung to the open position. In this manner, the forward motion of the reciprocal arm 105*f* causes the blocking bar 106 in the evacuation position to be pushed back to the vertical-swing mode and returned to the open position.

In this return method, the blocking bar 106 is upward swung from the evacuation position to the open position, and subsequently the blocking bar 106 in the open position is vertically swung to the closed position according to the normal swing motion for closing. The feeling that the blocking bar 106 is coming toward a driver is therefore avoided.

The electromagnetic device 121 for generating the resistance force against the biasing force by the biasing unit 110 is controlled by a control component 130 (of the control unit) for controlling the electricity to the electromagnetic device 121. Control signals, which are transmitted from a remote operation switch disposed in a booth or the like, are isolation-processed in a signal converter component 131 and then transmitted to the control component 130. The control signals include a turn-on/off instruction on the electromagnetic device 121 and a release instruction. In the power supply system for the electromagnetic device 121, an AC power source is electrically connected to a protective component 132 with one or more fuses, and after this fuse protection, AC-DC conversion is performed in a rectifier component 133. A power supply component 134 generates electrical power at different levels from the DC power by the rectifier component 133. In this embodiment, as an example, the power supply component 134 generates electrical power at four levels of 60V, 70V, 80V and 90V. These power levels are switched according to an instruction signal from a voltage switching component 135. The voltage switching component 135 transmits the instruction signal according to a button operation, dial operation or switch operation. In this embodiment, the power supply component 134 further generates polarity-reversed (+/−reversed) electrical power with 90V (maximum voltage). This polarity-reversed electrical power is output from the power supply component 134 in response to an instruction from the control component 130. The control component 130 in operation according to the control signal transmits a signal to an operation-state display 136 which is disposed on the housing 102 or in a booth. The operation-state display 136 informs the current operation state of the electromagnetic device 121 by means of LEDs, etc.

The voltage setting for the power supply component 134 by means of the voltage switching component 135 can be performed in the default settings for the pass blocking apparatus 101. As necessary, the voltage can be switched after the determination of the default settings. In this regard, the any one of the settable voltages is set in view of wind conditions and traffic conditions at the installation location of the pass blocking apparatus 101. According to this embodiment, the electromagnetic device 121 generates the minimum magnetic force in response to the minimum supply voltage of 60V, and generates the maximum magnetic force in response to the maximum supply voltage of 90V. Since the magnetic force by the electromagnetic device 121 that attracts the magnetic material 122 is the resistance force against the biasing force, the resistance force is regulated by means of the power switching of the power supply component 134.

Figure 9:
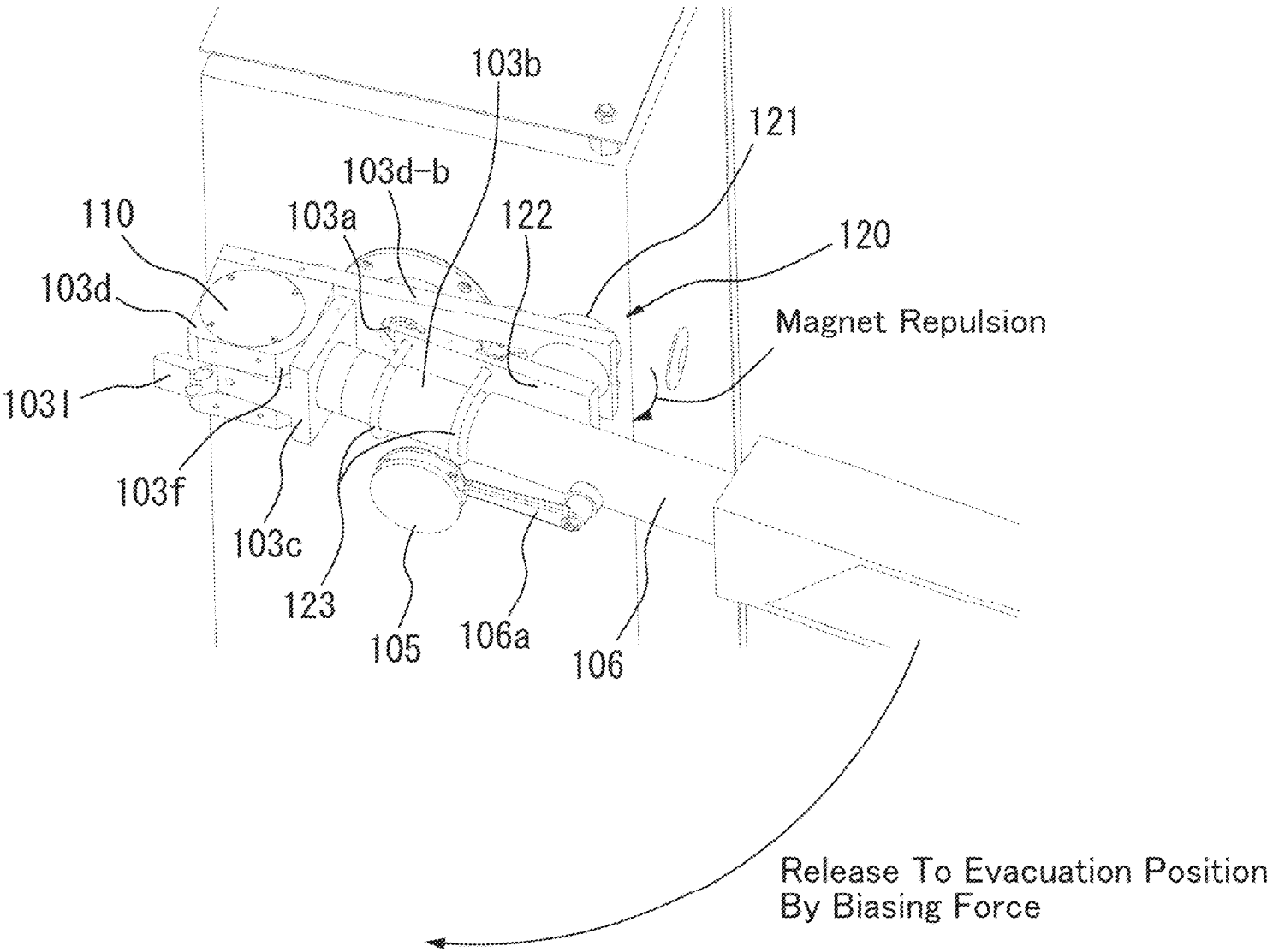
FIG. 9 shows a jumping-out mechanism in a release step by the resistance unit as shown in FIG. 6.

When receiving a control signal including a turn-on instruction, the control component 130 transmits the setup electrical power of the power supply component 134 to the electromagnetic device 121. The electromagnetic device 121 thereby functions as the resistance unit 120 for generating the resistance force in accordance with the supply power. The control component 130 receive a control signal including a release instruction from a release switch disposed on the housing 102 or in a booth. When receiving the release instruction, the control component 130 may cut off the electricity to turn off the power supply from the power supply component 134. Alternatively, in this embodiment, the control component 130 switches the power supply mode to a polarity-reversed-power supply mode for applying the polarity-reversed electrical power with 90V to the electromagnetic device 121. The electromagnetic device 121, which is operated with the polarity-reversed electrical power, generates a magnetic force with reversed N and S poles. As the result of this magnetic pole reversal, the magnetic pole of the electromagnetic device 121 that has faced the magnetic material 122 is turned to the identical pole with respect to the magnetic field of the magnetic material 122 (in this situation, N(S) pole faces N(S) pole). The magnetic material 122 thereby repels the electromagnetic device 121. As shown in FIG. 9, the bar holder 103*b* and the blocking bar 106 jump out and instantly and securely released as the result of the repulsion of the magnetic material 122. After the release, the control component 130 appropriately switches the polarity-reversed-power supply mode to the normal power supply mode with respect to the electromagnetic device 121 for the return of the blocking bar 106.

As described above, the electromagnetic device 121 generates the resistance force for holding the blocking bar 106 in the closed position against the biasing force. The resistance force is cancelled as necessary by control of the electricity to the electromagnetic device 121. The cancellation of the resistance force permits the blocking bar 106 to be swung depending on the biasing force from the closed position to the evacuation position. This means that the blocking bar 106 can be released to the evacuation position as necessary by button operation or the like.

Figure 10A:
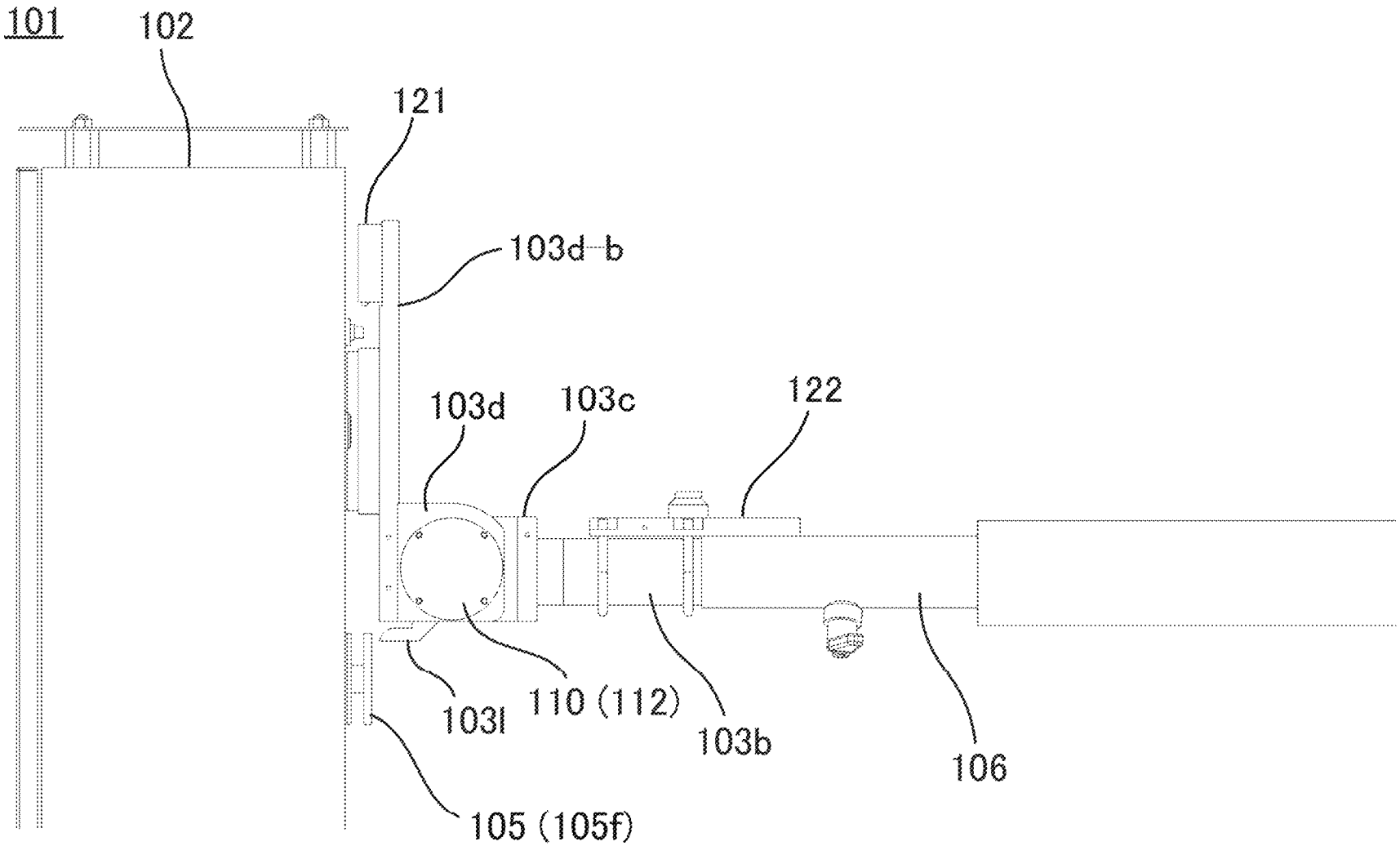
FIGS. 10A-10C show a series of steps for returning the released blocking bar.
Figure 10B:
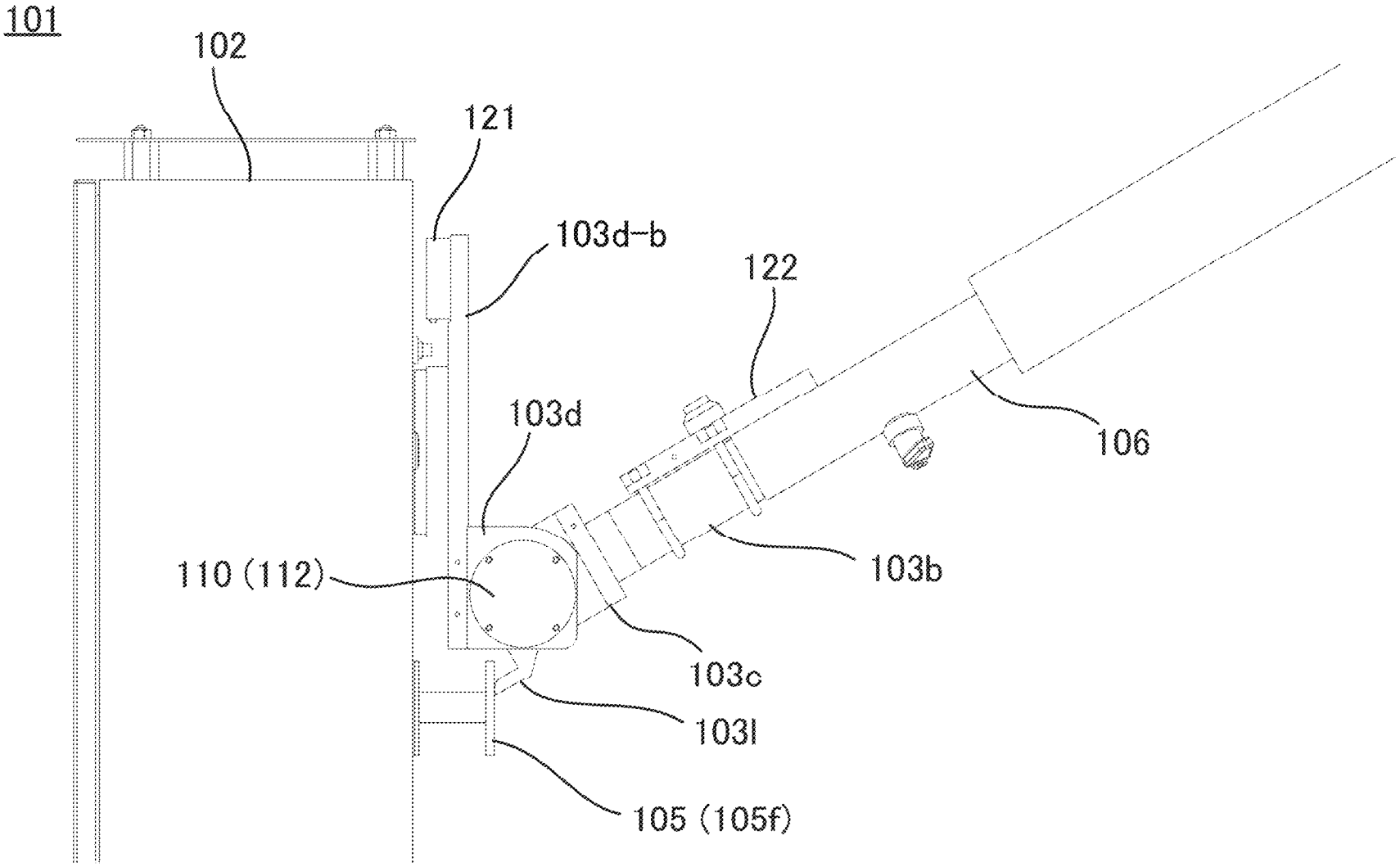
Figure 10C:
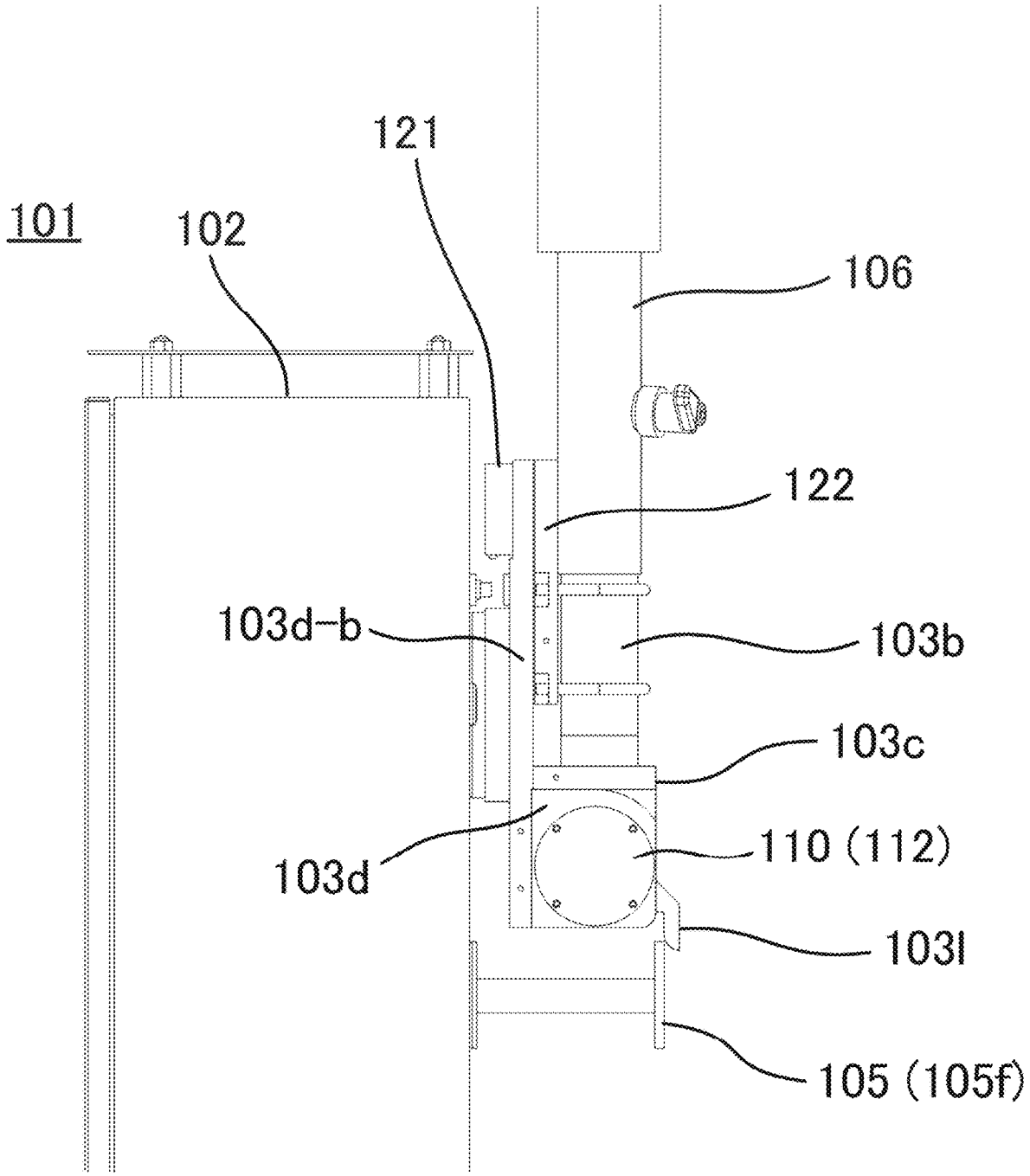

The blocking bar 106, which has been released to the evacuation position, can be returned according to the above-described return operation. In response to the return operation, the blocking bar driving device 3 rotates the driving shaft 103*a* to the position corresponding to the open position of the blocking bar 106 (FIG. 10A). The base 103*c* and the pivot support 103*d* of the hinge connection unit can be folded upward in this position. At the same time, the projection 1031 is directed downward by this rotation of the driving shaft 103*a*, and positioned in the position contactable with the reciprocal arm 105*f*. The forward-moved reciprocal arm 105*f* is in contact with the projection 1031 and pushes out the projection 1031 (FIG. 10B). The bar holder 103*b* is thereby swung upward. The blocking bar 106 in the evacuation position is pushed back to the vertical-swing mode according to the forward motion of the reciprocal arm 105*f* and then returned to the open position (FIG. 100).

Figures 13A, 13B, 13C:
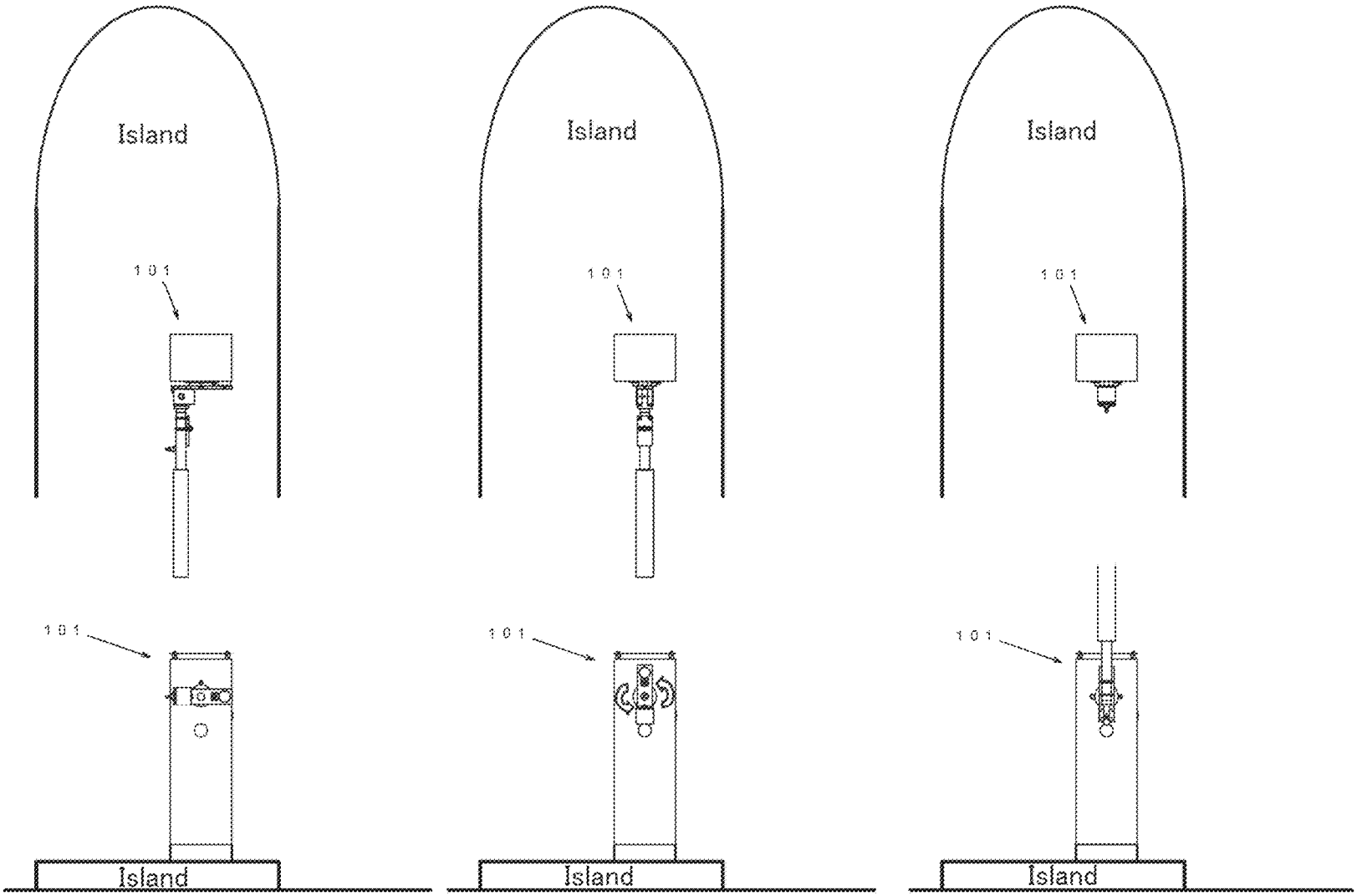
FIGS. 13A-13C show the pass blocking apparatus which is installed on an island beside an ETC lane, in a release state FIG. 13A, in a return start state FIG. 13B, and in a return completion state FIG. 13C, respectively.

For example, the pass blocking apparatus 101, which is installed at an ETC lane, vertically swings the blocking bar 106 in the normal mode between the closed position (FIG. 2A) and the open position (FIG. 2B) with respect to a passage. In contrast, all steps of the return operation of the blocking bar 106 from the evacuation position (including the case of evacuation caused by a vehicle collision) are completely performed within an island outside the passage (a booth area between passages), as shown in FIG. 13. There is no possibility that the blocking bar 106 in the return operation passes over the passage. The problem mentioned in the BACKGROUND ART above is also solved by this manner.

Figure 11A:
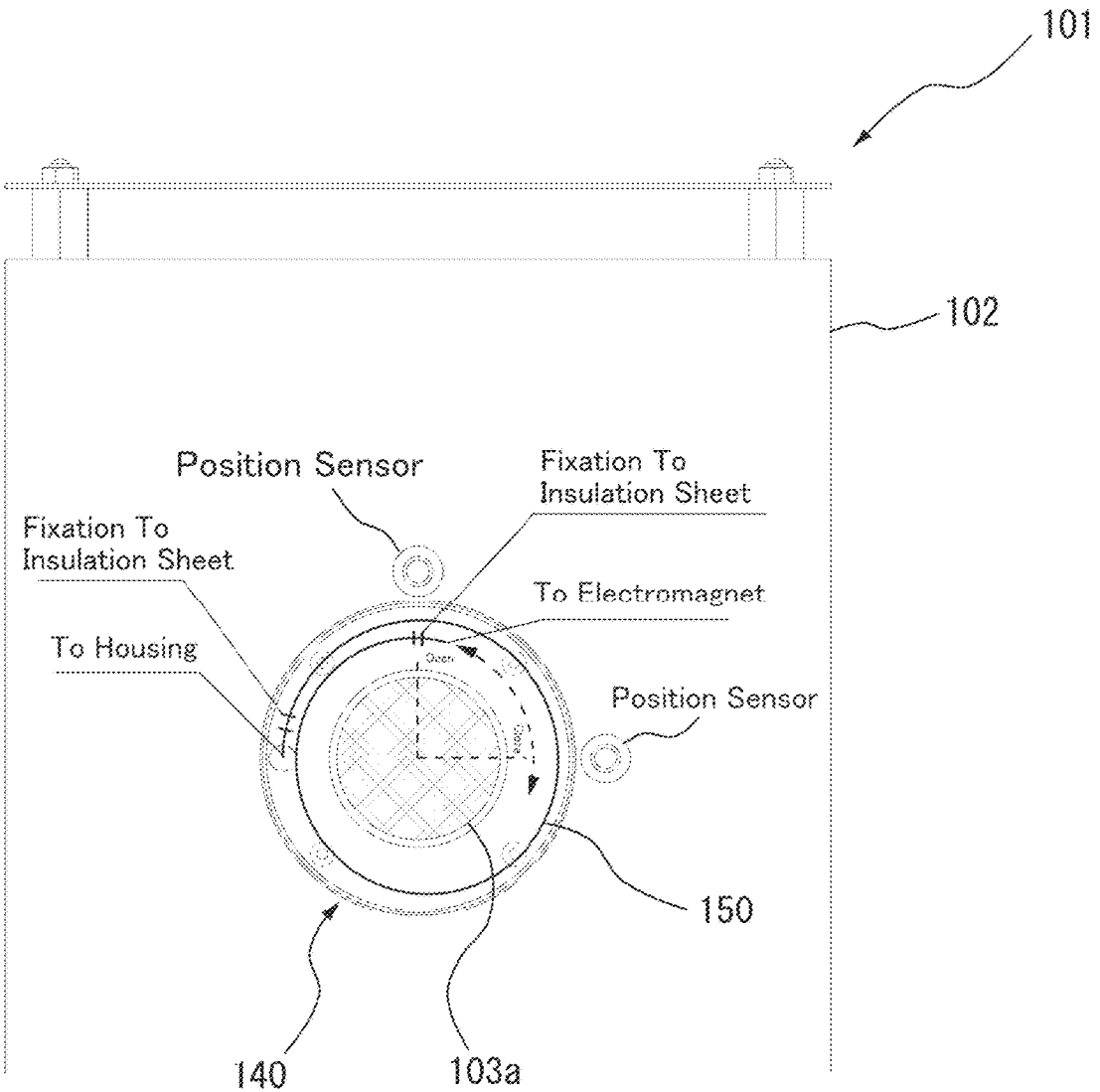
FIGS. 11A and 11B show wiring to the resistance unit.
Figure 11B:
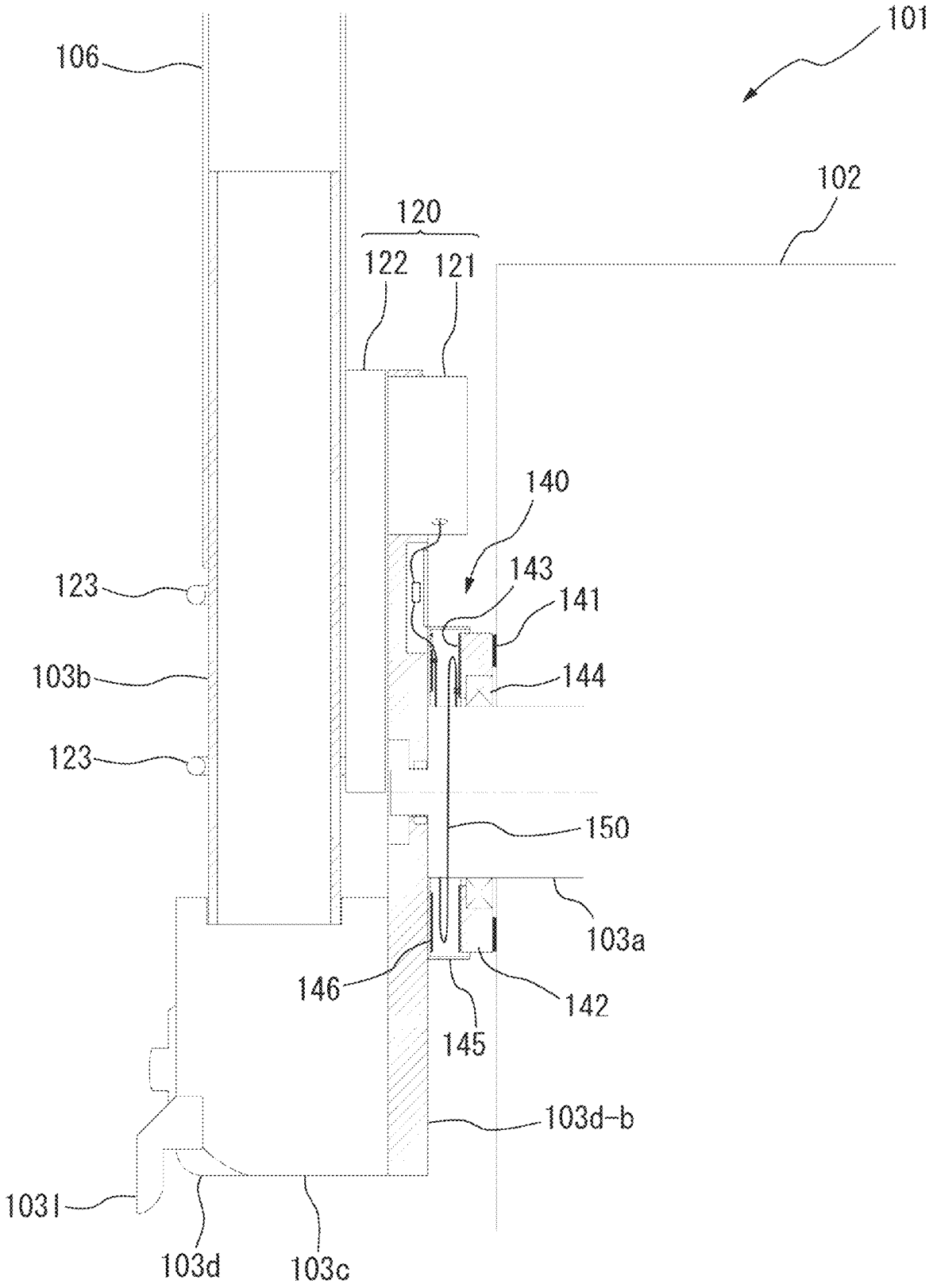
Figure 12A:
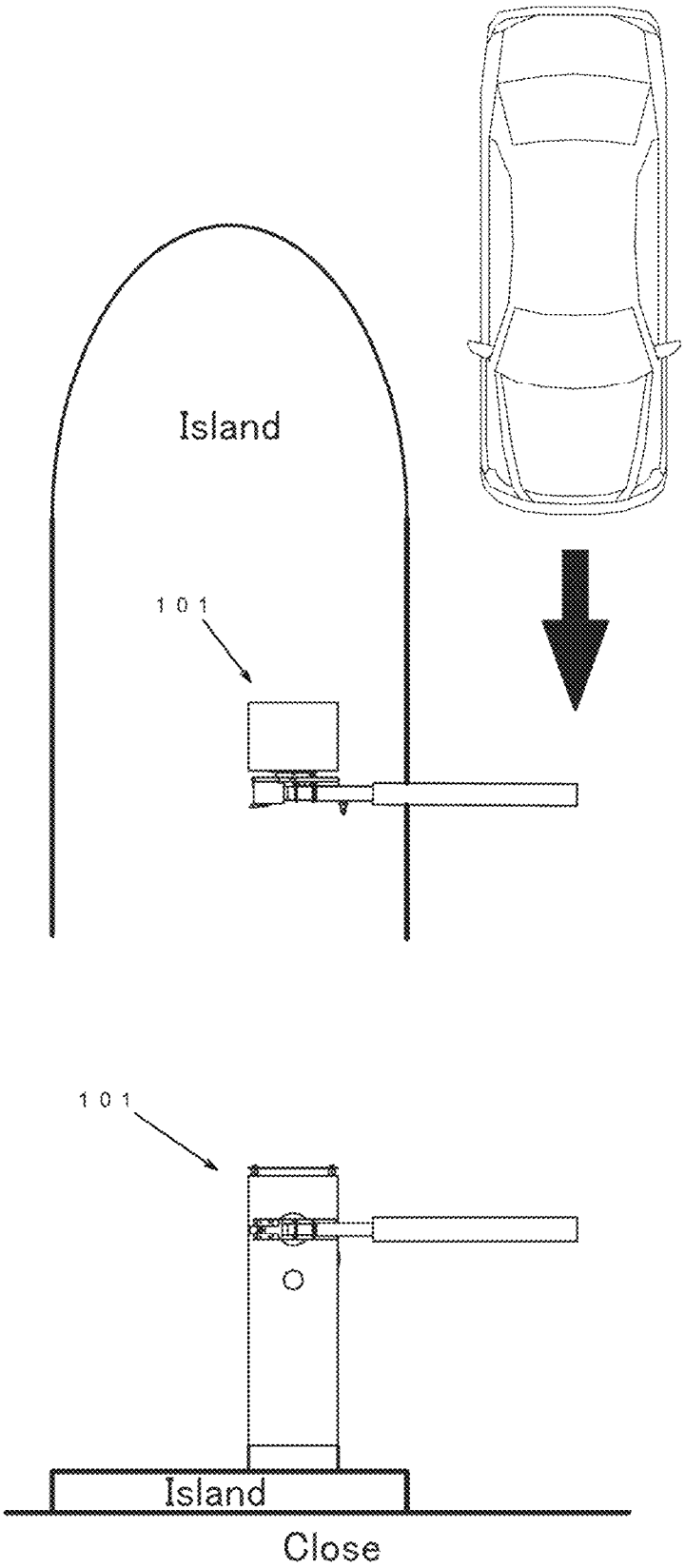
FIG. 12A shows the pass blocking apparatus in a closed state, which is installed on an island beside an ETC lane.
Figure 12B:
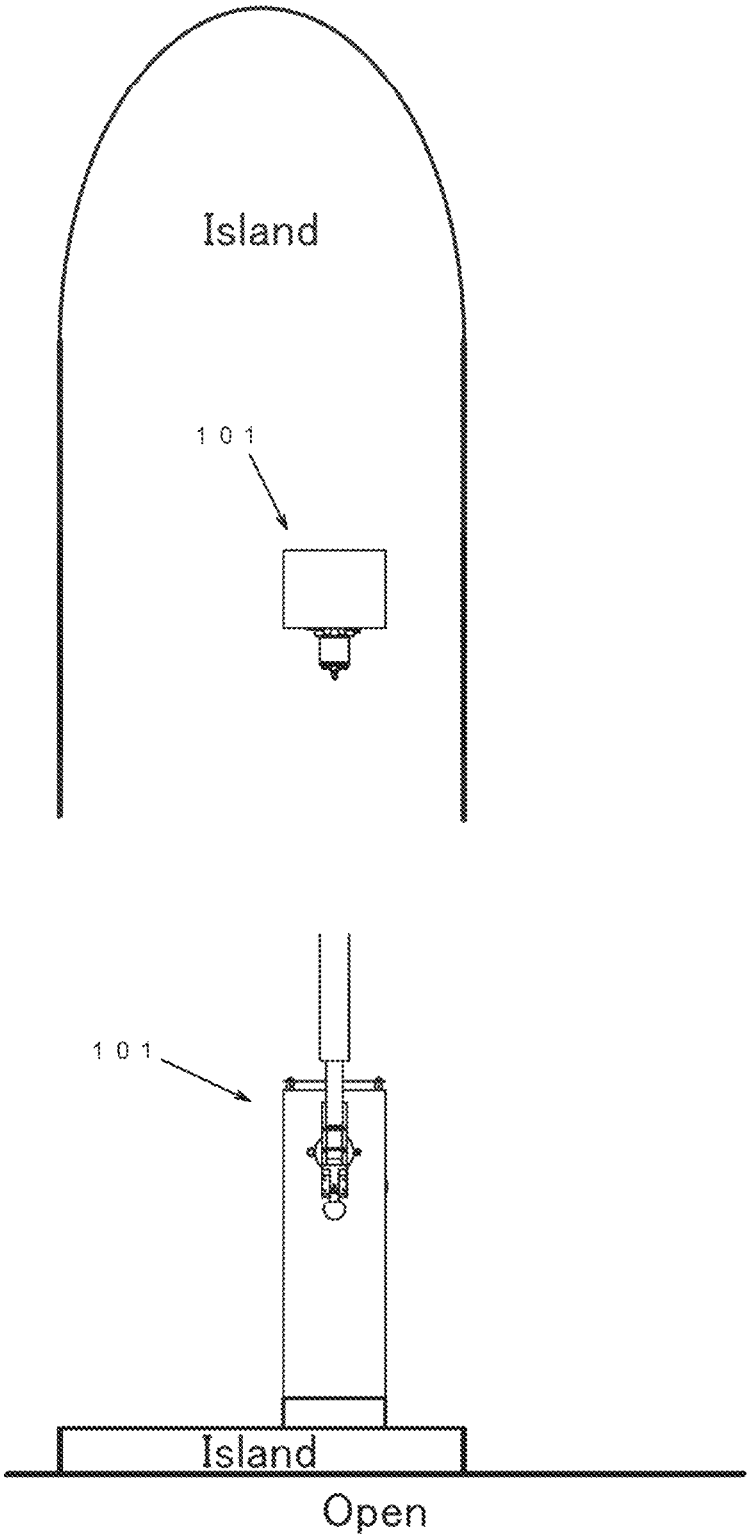
FIG. 12B shows the pass blocking apparatus of FIG. 12A in an open state.

The power supply wiring for the electromagnetic device 121 is described with reference to FIGS. 11A and 11B. FIG. 11A shows the inside of a wiring housing 140 surrounding the driving shaft 103*a*. FIG. 11B shows the cross-sectional view thereof.

As shown in FIG. 11A, a power supply cable 150 is led from the control component 130 inside the housing 102. This power supply cable 150 is pulled out from the housing 102, and then disposed in a loop fashion around the driving shaft 103*a* by a lap and a quarter inside the wiring housing 140 surrounding the driving shaft 103*a*. The power supply cable 150 is then pulled out from the wiring housing 140 to the electromagnetic device 121. The loop of the power supply cable 150 has a diameter wider than the diameter of the driving shaft 130*a*, thereby having a margin with respect to the driving shaft 130*a*. As the result of this margin, the loop of the power supply cable 150 is variable in the diameter. A plastic band is wound on the loop part inside the wiring housing 140 for effecting a spring function. This spring function provides constantly a radial-expansion force to the loop part of the power supply cable 150. While the blocking bar 106 is swung from the open position to the closed position by about 90 degrees, the terminal of the power supply cable 150, which extends to the electromagnetic device 121, is pulled by about 90 degrees (shown by the dotted arrow in FIG. 11A that shows the power supply cable 150 at the open position). The loop of the power supply cable 150 shrinks in response to this situation. On the other hand, when the blocking bar 106 is swung from the closed position to the open position, the loop of the power supply cable 150 expands radially according to the spring function in response to this situation. In this manner, the power supply cable 150 follows the swing of the blocking bar 106 with no contact by means of the shrinkage and expansion of the loop. This effects improved endurance in the power supply cable.

Hereinafter, the wiring housing 140 will be described in detail with reference to FIG. 11B. The wiring housing 140 has an annular dust-sealing member 141, a bearing holder 142 for pressing the dust-sealing member 141, and an annular insulation sheet 143 fixed on the surface of the bearing holder 142, in the vicinity of the housing 102. The bearing holder 142 holds a bearing 144 for the driving shaft 103*a*. In addition, the wiring housing 140 has a cylindrical cap 145 with a central hole for the passage of the driving shaft 103*a*, and an annular insulation sheet 146 fixed on the inner surface of the cap 145, in the vicinity of the base board 103*d-b* of the pivot support 103*d*. The cap 145 has a cylindrical side wall extending over the side of the bearing holder 142 for protecting against raindrops and dust.

The dust-sealing member 141, the bearing holder 142 and the insulation sheet 143 are provided with holes for the passage of the power supply cable 150. The power supply cable 150 is pulled out through the holes from the housing 102, and then fastened once to the insulation sheet 143 by means of an appropriate fastener. A part of the power supply cable 150 extending from this fastened position is disposed around the driving shaft 103*a* by a lap and a quarter to form the loop mentioned above, and then fastened to the insulation sheet 146 by means of an appropriate fastener. A part of the power supply cable 150 extending from this fastened position is led through the hole of the insulation sheet 146 to a wiring chamber formed in the base board 103*d-b*, and electrically connected to a wiring plug of the electromagnetic device 121 in the chamber.

The pass blocking apparatus according to the invention includes the electromagnetic device which is configured to generate the resistance force for holding the blocking bar in the closed position against the biasing force. The resistance force can be cancelled as necessary by means of the control of electricity to the electromagnetic device. The blocking bar is swung from the closed position to the evacuation position in response to the cancellation of the resistance force. This allows the blocking bar to be released as necessary to the evacuation position by means of a button operation or the like.

Although the embodiments of the invention have been described in detail, it should be understood that the various changes, substitutions, and alterations could be made hereto without departing from the spirit and scope of the invention.

LIST OF REFERENCE NUMBERS

101 Pass Blocking Apparatus
102 Housing
103*a* Driving Shaft
103*b* Bar Holder
103*c* Base
103*d* Pivot Support
103*e* Hinge Pivot
103*d-b* Base Board
105 Blocking Bar Return Device
105*f* Reciprocal Arm
106 Blocking Bar
110 Biasing Unit
111 Flat Spiral Spring
112 Cover
120 Resistance Unit
121 Electromagnetic Device
122 Magnetic Material
130 Control Component
134 Power Supply Component
135 Voltage Switching Component
140 Wiring Housing
150 Power Supply Cable

What is claimed is:

1. A pass blocking apparatus comprising:

a blocking bar extending perpendicularly to an axis of a driving shaft, the blocking bar being vertically swung by rotation of the driving shaft;

a hinge connection unit for connecting the blocking bar to the driving shaft, the hinge connection unit permitting the blocking bar to be horizontally swung from a closed position to an evacuation position;

a biasing unit for applying a biasing force to the blocking bar, wherein the blocking bar can be swung toward the evacuation position depending on the biasing force;

a resistance unit for providing a resistance force for holding the blocking bar in the closed position against the biasing force, wherein the resistance unit includes an electromagnetic device and a magnetic material, the resistance unit being configured to generate the resistance force from a magnetic force by the electromagnetic device that attracts the magnetic material;

a control unit which is configured to control electricity to the electromagnetic device; and a power supply component configured to supply electrical power at different levels to the electromagnetic device with the resistance force being adjusted by power switching of the power supply component.

2. The pass blocking apparatus according to claim 1, wherein the control unit is further configured to supply electrical power with reversed polarity to the electromagnetic device when controlling the electricity to the electromagnetic device in order to cancel the resistance force.

3. The pass blocking apparatus according to claim 2, wherein the power supply component is configured to supply the electrical power with reversed polarity to the electromagnetic device.

4. A pass blocking apparatus comprising:

a blocking bar extending perpendicularly to an axis of a driving shaft, the blocking bar being vertically swung by rotation of the driving shaft;

a hinge connection unit for connecting the blocking bar to the driving shaft, the hinge connection unit permitting the blocking bar to be horizontally swung from a closed position to an evacuation position;

a biasing unit for applying a biasing force to the blocking bar, wherein the blocking bar can be swung toward the evacuation position depending on the biasing force;

a resistance unit for providing a resistance force for holding the blocking bar in the closed position against the biasing force, wherein the resistance unit includes an electromagnetic device and a magnetic material, the resistance unit being configured to generate the resistance force from a magnetic force by the electromagnetic device that attracts the magnetic material; and a control unit which is configured to control electricity to the electromagnetic device, wherein the control unit is further configured to supply electrical power with reversed polarity to the electromagnetic device when controlling the electricity to the electromagnetic device in order to cancel the resistance force.

5. The pass blocking apparatus according to claim 4, further comprising a power supply component configured to supply the electrical power with reversed polarity to the electromagnetic device according to the control unit.

* * * * *